US010982535B2

(12) United States Patent
Wang

(10) Patent No.: US 10,982,535 B2
(45) Date of Patent: Apr. 20, 2021

(54) SYSTEMS AND METHODS FOR ESTIMATING HYDRAULIC FRACTURE SURFACE AREA

(71) Applicant: HanYi Wang, Austin, TX (US)

(72) Inventor: HanYi Wang, Austin, TX (US)

( * ) Notice: Subject to any disclaimer, the term of this patent is extended or adjusted under 35 U.S.C. 154(b) by 0 days.

(21) Appl. No.: 16/857,601

(22) Filed: Apr. 24, 2020

(65) Prior Publication Data

US 2021/0079788 A1 Mar. 18, 2021

Related U.S. Application Data

(60) Provisional application No. 62/900,533, filed on Sep. 14, 2019, provisional application No. 62/942,121, filed on Nov. 30, 2019.

(51) Int. Cl.

| | |
|---|---|
| ***E21B 49/00*** | (2006.01) |
| ***E21B 43/26*** | (2006.01) |
| ***E21B 47/06*** | (2012.01) |

(52) U.S. Cl.

CPC ..... *E21B 49/00* (2013.01); *E21B 43/26* (2013.01); *E21B 47/06* (2013.01); *E21B 2200/20* (2020.05)

(58) Field of Classification Search

CPC ..... E21B 43/26; E21B 47/06

See application file for complete search history.

(56) References Cited

U.S. PATENT DOCUMENTS

| | | | | |
|---|---|---|---|---|
| 4,836,284 | A * | 6/1989 | Tinker | C09K 8/72 166/279 |
| 5,070,457 | A * | 12/1991 | Poulsen | E21B 43/26 166/250.09 |
| 5,325,921 | A * | 7/1994 | Johnson | C09K 8/08 166/280.1 |
| 8,066,073 | B2 | 11/2011 | Hutchins et al. | |
| 9,366,121 | B2 | 6/2016 | Copeland | |
| 10,415,359 | B2 | 9/2019 | Green | |
| 10,494,918 | B2 | 12/2019 | Coenen et al. | |
| 10,570,729 | B2 | 2/2020 | Santarelli | |
| 2007/0235181 | A1 | 10/2007 | Lecampion et al. | |

(Continued)

OTHER PUBLICATIONS

Pattillo, Phillip D. "A Modification of Carter's Equation for Fracture Area" (1975), Society of Petroleum Engineers, SPE-5630-MS (Year: 1975).*

*Primary Examiner* — Robert E Fuller

(74) *Attorney, Agent, or Firm* — Kanika Radhakrishnan; Evergreen Valley Law Group

(57) ABSTRACT

A method for determining surface area of a created hydraulic fracture that originated from a wellbore. Pressure in the wellbore is monitored after creation and extension of the created hydraulic fracture. Injection rate of an injection fluid to the created hydraulic fracture is regulated. This is done to maintain a constant pressure for a continuous period of time. The injection rate is regulated such that the created hydraulic fracture maintains its current dimensions and the injection rate of the injection fluid into the created hydraulic fracture equals the total fluid leak-off rate from the created hydraulic fracture. The constant fracture pressure is larger than a formation pore pressure and smaller than a fracture propagation pressure. Finally, a numerical simulation is performed to obtain the relationship between the total fluid leak-off rate and the surface area of the created hydraulic fracture.

24 Claims, 13 Drawing Sheets

(56) References Cited

U.S. PATENT DOCUMENTS

| | | | | |
|---|---|---|---|---|
| 2017/0328179 | A1* | 11/2017 | Dykstra | E21B 49/008 |
| 2018/0106136 | A1* | 4/2018 | Yang | E21B 43/1195 |
| 2019/0040305 | A1* | 2/2019 | Ruyle | C09K 8/68 |

* cited by examiner

SYSTEMS AND METHODS FOR ESTIMATING HYDRAULIC FRACTURE SURFACE AREA

FIELD OF THE PRESENT DISCLOSURE

The present disclosure relates to systems and methods of injecting fluid at various subterranean rock formations, such as hydrocarbon reservoir and geothermal reservoir, implementing a process known as hydraulic fracturing. More particularly, but not by way of limitation, embodiments of the present disclosure relate to systems and methods for estimating hydraulic fracture surface area and the associated fluid leak-off rate.

BACKGROUND

Production of hydrocarbons from a subterranean formation may be affected by many factors including pressure, porosity, permeability, reservoir thickness and extent, water saturation, capillary pressure, etc. Generally, to increase production from a wellbore and/or to facilitate the flow of hydrocarbons from a subterranean formation, stimulation treatment operations, such as hydraulic fracturing, may be performed. Hydraulic fracturing is a standard practice in enhancing the production of hydrocarbon products from low permeability rocks, such as shale oil/gas formations. In almost all horizontal wells and some vertical wells, the wellbore is divided into several sections, and hydraulic fracturing is executed in each section sequentially. A hydraulic fracturing stage is a section of the wellbore that is being hydraulic fractured and each hydraulic fracturing stage is isolated from previous hydraulic fractured stages by an isolating device. Today, horizontal wells in the U.S. commonly have 20-40 hydraulic fracturing stages.

During hydraulic fracturing treatment, pressurized fluids are injected into a wellbore to overcome the breaking strength of rock. Consequently, one or more hydraulic fractures are initiated that subsequently propagate away from the wellbore into the reservoir until fluids injection stops. Eventually, the created hydraulic fractures serve as conductive pathways through which hydrocarbon products migrate en-route to the wellbore and are brought up to the surface. In general, as the hydraulic fracture surface area becomes larger, the reservoir contact area between the wellbore-fracture system and hydrocarbon-bearing formation also gets larger, and it leads to more production.

Knowing how much hydraulic fracture surface area has been created is critical in assessing stimulation efficiency, quantifying geological uncertainties and calibrating hydraulic fracturing models. Injectivity tests that are typically performed in geothermal and injection wells, using a constant injection rate or a series of discrete constant injection rate intervals, can be used to estimate the overall formation transmissibility and wellbore skin factor, but the stimulated fracture surface area cannot be quantified. Injection flowback techniques combined with chemical tracer can infer hydraulic fracture surface area, but only limited to the near well-bore region. Micro-seismic data gathered during hydraulic fracturing can be used to detect shear failures, but it only provides the upper bound of how far hydraulic fractures can propagate. Hydraulic fracture induced poroelastic pressure response in offset wells can be used to constrain fracture dimensions, but such quantitative analysis is often non-unique and not well-bounded, and requires assumptions of planar fracture geometry and knowledge of closure stress, rock mechanical properties and fracture size in the offset wells.

Currently, production data are commonly used to estimate hydraulic fracture surface area via rate transient analysis (RTA). However, RTA has several drawbacks, such as: (i) it relies heavily on the identification and analysis of the linear flow regime, however, the linear flow regime may not emerge in some heterogeneous reservoirs where power-law behaviors dominate; (ii) its accuracy is compromised if the reservoir exhibits highly pressure-dependent in-situ properties (e.g., pressure-dependent viscosity, compressibility or permeability) or non-Darcy flow (e.g., gas slippage in nanopores) as production pressure declines over time; (iii) multiphase flow and phase change behavior in the reservoir and wellbore during production makes it difficult to analyze the production data; and (iv) it only estimates the total hydraulic fracture surface area originated along the entire wellbore and cannot distinguish fracture surface area from each hydraulic fracturing stage in a multistage fractured horizontal well (MFHW), because continuous production rate and pressure data within each individual hydraulic fracturing stage are often not available during production.

Based on the above, better means for estimating hydraulic fracture surface area are desired, especially systems and methods that are not only compatible with current field practices and procedures, but also can estimate hydraulic fracture surface area for each individual hydraulic fracturing stage of a MFHW.

SUMMARY

The present disclosure relates to methods and systems of extracting/injecting fluid at various subterranean rock formations, such as hydrocarbon and geothermal reservoirs. More particularly, but not by way of limitation, embodiments of the present disclosure relate to systems and methods for determining fluid leak-off rate and estimating the corresponding hydraulic fracture surface area by following a desired injection rate and pressure after the hydraulic fracture is created, such that the created hydraulic fracture is neither closing, dilating nor propagating. The injection rate is regulated to ensure that the rate of fluid injected into the created hydraulic fracture equals the total fluid leak-off rate from the created hydraulic fracture so that the created hydraulic fracture maintains its current dimensions with a constant fracture pressure. The surface area of the created hydraulic fracture (i.e., hydraulic fracture surface area) is then estimated using a fluid leak-off model. Once the hydraulic fracture surface area is estimated, the hydraulic fracture volume can further be calculated based on volume balance.

In an aspect, a method for estimating hydraulic fracture surface area that originated from a wellbore is provided. The method comprises monitoring pressure in the wellbore during and after hydraulic fracture creation and extension. Further, the method comprises identifying a fracture pressure, wherein the identified fracture pressure is larger than a formation pore pressure and smaller than a fracture propagation pressure. The method also includes regulating the injection rate of an injection fluid to a created hydraulic fracture to maintain a constant fracture pressure, such that the created hydraulic fracture maintains its current dimensions and the injection rate of the injection fluid into the created hydraulic fracture equals the total fluid leak-off rate from the created hydraulic fracture, wherein the constant fracture pressure equals the identified fracture pressure. The method also includes utilizing a fluid leak-off model to estimate the surface area of the created hydraulic fracture, wherein the fluid leak-off model provides the relationship between the total fluid leak-off rate and the hydraulic fracture surface area.

In one or more embodiments, the method further comprises estimating the formation pore pressure and the fracture propagation pressure.

In one or more embodiments, regulating the injection rate of the injection fluid to the created hydraulic fracture is achieved by regulating the injection rate of the injection fluid to the wellbore.

In one or more embodiments, the entire wellbore receives the regulated injection fluid.

In one or more embodiments, a section of the wellbore that receives the regulated injection fluid is isolated from one or more other sections of the wellbore by an isolating device. The isolating device may be, but not limited to, a packer or a bridge plug.

In one or more embodiments, flow-back is executed to facilitate a decline of fracture pressure.

In one or more embodiments, the injection rate of the injection fluid is regulated manually or regulated by an automatic control system.

In one or more embodiments, a rate step-down test (RST) is executed to quantify the relationship between the injection rate and friction loss.

In one or more embodiments, maintaining a constant fracture pressure is achieved by regulating the injection rate of the injection fluid such that a bottom-hole pressure or a surface pressure is maintained at a constant level.

In one or more embodiments, the fluid leak-off model is an analytical leak-off model or semi-analytical leak-off model or a numerical leak-off model.

In one or more embodiments, the fluid leak-off model is used to calculate the fluid leak-off rate and the associated total fluid leak-off volume during and after hydraulic fracture creation and extension (i.e., hydraulic fracture initiation and propagation).

In one or more embodiments, the wellbore is a vertical wellbore, or a deviated wellbore or a horizontal wellbore.

In one or more embodiments, surface area of the created hydraulic fracture is estimated multiple times at different fracture pressures.

In one or more embodiments, the wellbore is a multistage hydraulic fractured horizontal well (MFHW), and wherein the hydraulic fracture surface area and the associated fluid leak-off rate of each of the individual hydraulic fracturing stage is determined by separately introducing the regulated injection fluid therein.

In one or more embodiments, the total fluid leak-off rate from the created hydraulic fracture that originated from an isolated section of the wellbore is determined by only introducing the regulated injection fluid to the isolated section of the wellbore.

In one or more embodiments, the surface area of the created hydraulic fracture that originated from an isolated section of the wellbore is estimated by only introducing the regulated injection fluid to the isolated section of the wellbore.

In one or more embodiments, the total fluid leak-off rate from the created hydraulic fracture that originated from the entire section of the wellbore is determined by introducing the regulated injection fluid to the entire section of the wellbore.

In one or more embodiments, the surface area of the created hydraulic fracture that originated from the entire section of the wellbore is estimated by introducing the regulated injection fluid to the entire section of the wellbore.

In one or more embodiments, the method further comprises calculating the volume of the created hydraulic fracture based on volume balance, wherein the hydraulic fracture volume equals the fluid injection volume received by the created hydraulic fracture minus the total fluid leak-off volume from the created hydraulic fracture.

In another aspect, a system for estimating hydraulic fracture surface area that originated from a wellbore is provided. The system comprises a data storing arrangement configured to store a fluid leak-off model, pressure and injection rate data, and wellbore configuration data (e.g., wellbore length, depth and wellbore diameter, number of perforations and perforation diameter, etc.). The system also comprises an automatic control system. The automatic control system comprises a pressure gauge configured to monitor pressure during and after hydraulic fracture creation and extension in the wellbore. The automatic control system also comprises a fluid injection device (e.g., an injection pump) configured to inject fluid to a created hydraulic fracture. The system further comprises a data processing arrangement communicatively coupled to the data storing arrangement and automatic control system. The data processing arrangement is configured to identify, via the pressure gauge, a fracture pressure, wherein the identified fracture pressure is larger than a formation pore pressure and smaller than a fracture propagation pressure; regulate, via the fluid injection device, injection rate of an injection fluid to the created hydraulic fracture to maintain a constant fracture pressure, such that the created hydraulic fracture maintains its current dimensions and the rate of fluid injected into the created hydraulic fracture equals the total fluid leak-off rate from the created hydraulic fracture, wherein the constant fracture pressure equals the identified fracture pressure; and utilize the fluid leak-off model to estimate the surface area of the created hydraulic fracture, wherein the fluid leak-off model provides the relationship between the total fluid leak-off rate and the hydraulic fracture surface area.

In one or more embodiments, the pressure gauge is installed on at least one of: a surface pipeline connecting to the wellbore, a junction of the surface pipeline, a wellhead of the wellbore, and within the wellbore.

In one or more embodiments, the automatic control system comprises a controller to regulate the injection rate of the injection fluid to the created hydraulic fracture to maintain a constant fracture pressure, wherein the controller can be, but not limited to, a proportional-integral-derivative (PID) controller.

In another aspect, a computer-program product for estimating hydraulic fracture surface area that originated from a wellbore is provided. The computer-program product has computer-readable instructions stored therein that, when executed by a processor, cause the processor to perform a method step comprising: receiving and storing pressure data during and after hydraulic fracture creation and extension; identifying a fracture pressure, wherein the identified fracture pressure is larger than a formation pore pressure and smaller than a fracture propagation pressure; regulating injection rate of an injection fluid to a created hydraulic fracture to maintain a constant fracture pressure, such that the created hydraulic fracture maintains its current dimensions and the rate of fluid injected into the created hydraulic fracture equals the total fluid leak-off rate from the created hydraulic fracture, wherein the constant fracture pressure equals the identified fracture pressure; and utilizing a fluid leak-off model to estimate the surface area of the created hydraulic fracture, wherein the fluid leak-off model provides the relationship between the total fluid leak-off rate and the hydraulic fracture surface area.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

Advantages of the present invention may become apparent to those skilled in the art with the benefit of the following detailed description and upon reference to the accompanying drawings in which.

Figure 1:
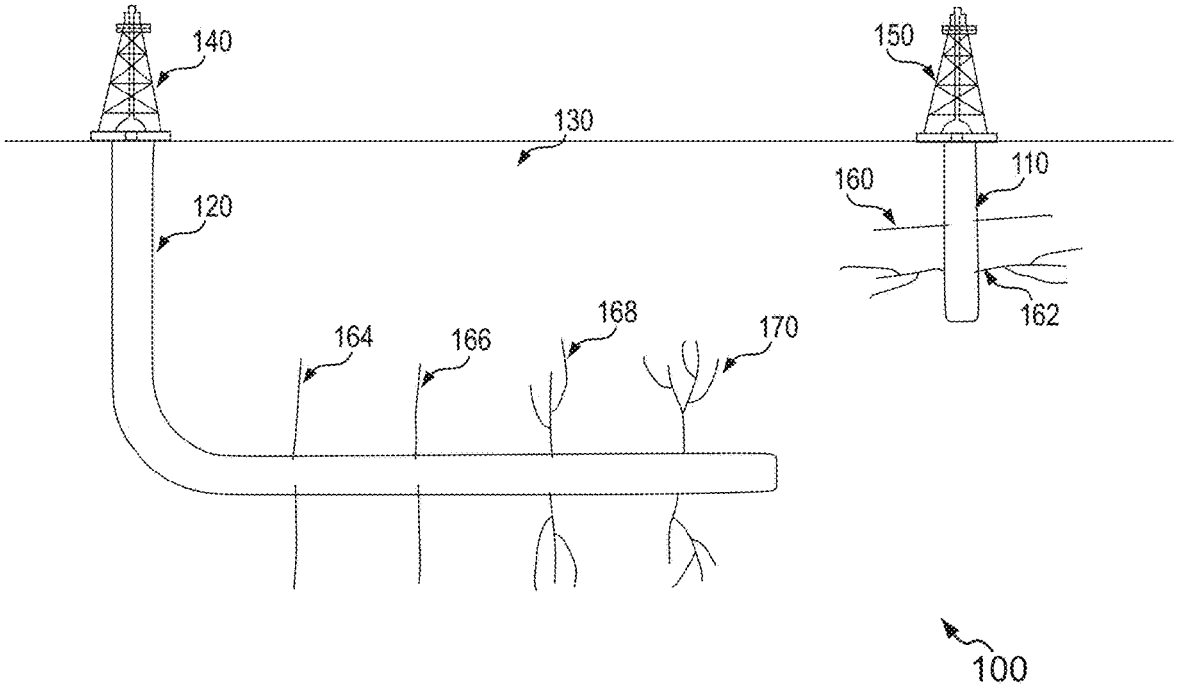
FIG. 1 depicts an exemplary illustration of a system for hydraulic fracturing a vertical well and a horizontal well, in accordance with one or more embodiments of the present disclosure.

While the disclosure is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications, equivalents, and alternatives falling within the spirit and scope of the present disclosure as defined by the appended claims.

DETAILED DESCRIPTION

In the following description, for purposes of explanation, numerous specific details are set forth in order to provide a thorough understanding of the present disclosure. It will be apparent, however, to one skilled in the art that the present disclosure is not limited to these specific details. Moreover, various features are described which may be exhibited by some embodiments and not by others. Similarly, various requirements are described which may be requirements for some embodiments but not for other embodiments.

Reference in this specification to "one embodiment" or "an embodiment" means that a particular feature, structure, or characteristic described in connection with the embodiment is included in at least one embodiment of the present disclosure. The appearance of the phrase "in one embodiment" in various places in the specification is not necessarily all referring to the same embodiment, nor are separate or alternative embodiments mutually exclusive of other embodiments. Further, the terms "a" and "an" herein do not denote a limitation of quantity, but rather denote the presence of at least one of the referenced items. Thus, for example, the reference to "a fracture" includes a combination of two or more fractures, reference to "a fluid leak-off model" includes a combination of a fluid leak-off model for hydraulic fracture creation and extension period and a fluid leak-off model for pressure fall-off period and reference to "a material" includes mixtures of materials. For the purposes of this disclosure, the term "fluid leak-off model" is also referred to as "leak-off model" in some instances, the term "hydraulic fracture" is also referred to as "fracture" in some instances, and the term "pressure gauge" refers to any sensor or device that can provide a pressure measurement, without any limitations.

"Fluid leak-off rate" or "leak-off rate" refers to fluid leak-off rate from a created hydraulic fracture, unless otherwise specified.

"Surface pressure" refers to the pressure at or near the surface of a wellbore.

"Bottom-hole" refers to the section of a wellbore at or near the depth where hydraulic fracture is initiated from.

"Bottom-hole pressure" refers to the pressure in a wellbore at or near the depth where hydraulic fracture is initiated from. When friction loss is negligible, the bottom-hole pressure equals fracture pressure.

"Hydraulic fracturing" or "fracking" or "fracturing" refers to creating or opening fractures that extend from the wellbore into the adjacent rock formation including the wellbore. A fracturing fluid may be injected into the formation with sufficient hydraulic pressure to create and extend fractures, open pre-existing natural fractures, or cause slippage of faults. The fractures enable fluid flow within a geological formation that has small matrix permeability, for example, carbonate, organic-rich shale, hot-dry granite being a geothermal energy source, and the like.

A "fluid" may be, but is not limited to, a gas, a liquid, an emulsion, a slurry, or a stream of solid particles that has flow characteristics similar to liquid flow. For example, the fluid can include water-based liquids having chemical additives. Further, the chemical additives can include, but are not limited to, acids, gels, potassium chloride, surfactants, and so forth.

"Proppant" is a solid material, typically sand, treated sand or man-made ceramic materials, designed to maintain hydraulic fracture conductivity after the closure of hydraulic fracture. It is added to the injection fluid during hydraulic fracturing operations.

"Formation" is a body of rock that is sufficiently distinctive and continuous. Hydrocarbon often accumulates and stored in sandstone formation, carbonate formation and shale formation.

"Reservoir" is a porous and permeable rock formation at subsurface that acts as a storage space for fluids. These fluids may be water, hydrocarbons or gas. The reservoirs include spaces within rock formations that may have been formed naturally (such as, due to erosion, tectonic movement and so forth) or spaces that may have been formed due to human activities (such as, mining activities, construction activities and the like). A reservoir can have one or more formations. In low permeability reservoirs, most hydraulic fracturing treatment targets one formation at a time and the hydrocarbon-bearing formation itself can be considered as a reservoir. As used in this disclosure, the terms "reservoir" and "formation," when referring to a body of rock containing the hydraulic fracture, are interchangeable.

"Conventional reservoir" refers to a reservoir that has good permeability and can flow with ease towards the wellbore, even without hydraulic fracturing. Conventional reservoir includes most carbonate and sandstone reservoirs that have permeability above 0.1 millidarcy.

"Unconventional reservoir" refers to a reservoir that requires special recovery operations outside the conventional operating practices. Unconventional reservoirs include reservoirs such as tight-gas sands, gas and oil shales, coalbed methane, heavy oil and tar sands, and gas-hydrate deposits. Special recovery operations include hydraulic fracturing, thermal stimulation, etc.

"Wellbore" refers to a hole in a rock formation made by drilling or insertion of a conduit into the formation. The wellbore can be employed for injecting fluids into the rock formation including the wellbore, such as, for extracting hydrocarbon products from the rock formation. Generally, the wellbore is formed to have a cylindrical shape, such that, the wellbore may have a circular cross-section. Alternatively, the wellbore may have any other cross-section. The wellbore may be open-hole such that the hole corresponding to the wellbore is drilled into the rock formation and subsequently, no components are arranged into the wellbore. Alternatively, the wellbore may be cased, such as, by arranging a steel casing into a drilled hole corresponding to the wellbore ("casing" is an elongate, hollow, cylindrical component that is arranged within the wellbore to conform to an internal surface of the wellbore). Subsequently, the casing can be cemented to firmly affix the casing into the wellbore. As used herein, the terms "well," "borehole," and "open-hole" when referring to an opening in the rock formation has been used interchangeably with the term "wellbore".

It should be acknowledged that the word "constant" used in this disclosure does not mean that the specified term has absolute zero change, but rather, it is used to specify a term that remains at a stable level with acceptable small changes under engineering practice. For example, the term "constant fracture pressure" in this disclosure also has the meaning of "approximately constant fracture pressure". Also, it should be acknowledged that the word "equal" used in this disclosure does not mean the specified terms are exactly the same, but rather, it is used to specify two terms that have negligible quantitative differences under engineering practice. For example, the term "equal" in this disclosure can also have the meaning of "approximately equal".

The systems and methods described herein may be used together with other techniques and simulation models, such as pressure transient analysis, pressure decline analysis, rate transient analysis, geo-mechanical modeling, hydraulic fracture propagation simulator, etc., to estimate or confine hydraulic fracture length, hydraulic fracture height and/or hydraulic fracture width.

Nomenclature $P_{frac}$ is Fracture pressure (i.e., pressure inside hydraulic fracture), Pa;

$P_h$ is Hydrostatic pressure, Pa;

$P_f$ is Friction loss (i.e., pressure loss due to friction), Pa;

$P_S$ is Surface pressure, Pa;

$\rho$ is Density of injection fluid, $kg/m^3$;

H is True vertical depth of injection fluid column along a wellbore that measured from the surface to the depth where hydraulic fracture is initiated from, m;

g is Standard gravity, 9.8 $m/s^2$;

$Q_{inj}$ is Bottom-hole injection rate (i.e., injection rate to a created hydraulic fracture), $m^3/s$;

$Q_{inj_s}$ is Surface injection rate, $m^3/s$;

$Q_l$ is Total leak-off rate from a created hydraulic fracture, $m^3/s$;

B is Injection fluid volume factor, defined as the ratio of injection rate at bottom-hole conditions to the injection rate at surface conditions;

t is Time since the start of hydraulic fracture creation and extension, s;

$t_0$ is Total pumping time during the creation and extension of hydraulic fracture, s;

$\Delta t$ is Total elapsed time since the end of the creation and extension of hydraulic fracture, s;

$t_D$ is Dimensionless time;

$f(t_D)$ is Dimensionless loss-rate function;

$C_l$ is Total leak-off coefficient, m/√s;

$f_p$ is Ratio of leak-off fracture surface area to total fracture surface area;

$A_f$ is Hydraulic fracture surface area of one wall (one hydraulic fracture has two opposite walls), $m^2$;

$V_f$ is Hydraulic fracture volume, $m^3$;

$V_{inj}$ is Total fluid injection volume received by a created hydraulic fracture, $m^3$;

$V_l$ is Total fluid leak-off volume from a created hydraulic fracture, $m^3$;

FIG. 1 depicts an exemplary illustration of a system 100 for hydraulic fracturing a vertical well 110 and a horizontal well 120 within a subterranean rock formation 130, in accordance with one or more embodiments of the present disclosure. During hydraulic fracturing operation, an injection fluid is pumped from surface facilities 140, 150 into the wells 110, 120. Once the bottom-hole pressure reaches the break-down pressure of subterranean rock formation 130, hydraulic fractures 160, 162, 164, 166, 168, 170 will initiate from the wells 110, 120 and propagate into the subterranean rock formation 130 until injection stops. Normally, as can be seen from FIG. 1, hydraulic fractures (such as hydraulic fractures 160, 164, 166 in FIG. 1) form planar fracture geometry and propagate perpendicular to the minimum principal stress. However, under certain geological conditions, some hydraulic fractures (such as hydraulic fractures 162, 168, 170 in FIG. 1) may interact with pre-existing natural fractures to form complex fracture geometry.

Figure 2:
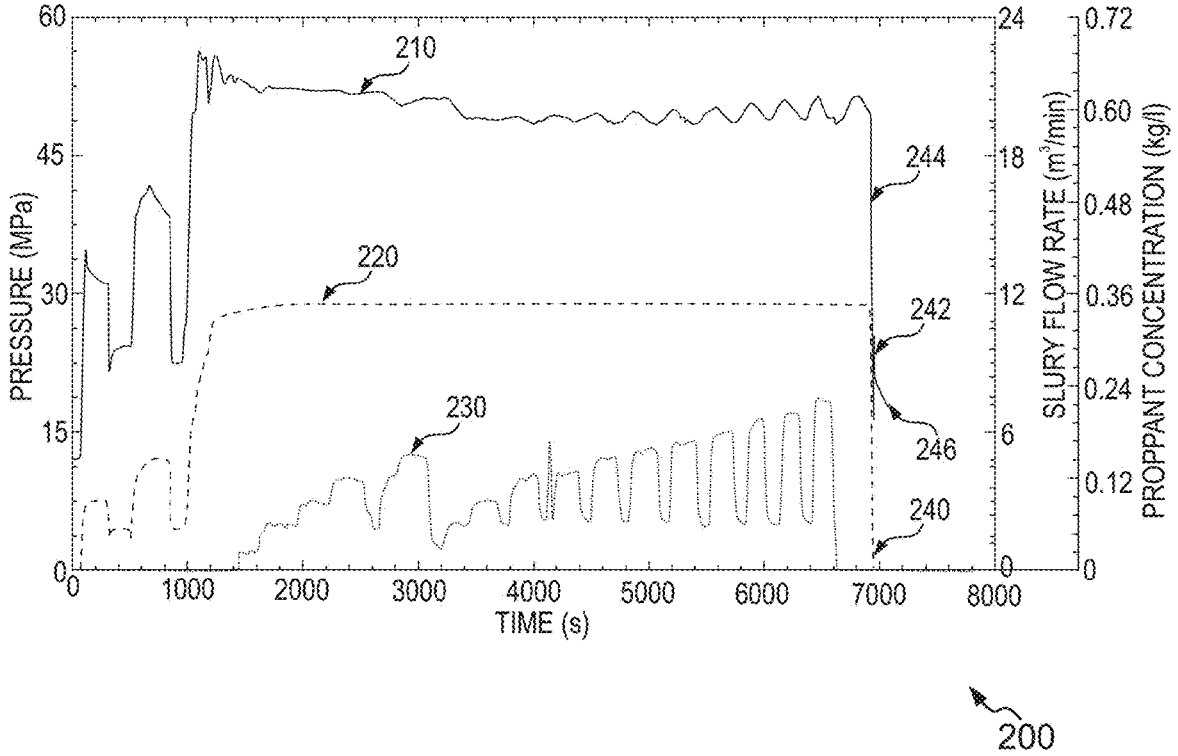
FIG. 2 depicts a graph representing recorded field data of a hydraulic fracturing stage of a MFHW, in accordance with one or more embodiments of the present disclosure.

FIG. 2 depicts a graph 200 representing recorded field data of a hydraulic fracturing stage of a MFHW in a shale formation, in accordance with one or more embodiments of the present disclosure. For recording such data, readings related to pressure (represented by plot 210), injection rate (represented by plot 220) and proppant concentration (represented by plot 230) are measured at a surface of the wellbore (such as, at the surface facility 140 or 150 in FIG. 1). After shut-in (represented by numeral 240) of the pump, the injection rate 220 drops to zero and measured surface pressure 210 drops instantaneously. It may be appreciated that depending on how fast the injection rate drops to zero, the water-hammer effect (which is represented by the numeral 242) with fluctuation pressure may occur. As can be seen, a large pressure drop (which is represented by the numeral 244) occurs right after the shut-in 240, which is mainly attributed to the diminishing friction loss along the wellbore; because friction loss is a function of flow rate, and lower the injection rate, the lower is the friction loss. After the water-hammer effect 242, pressure 210 gradually declines (which is represented by the numeral 246) due to fluid leak-off from the created hydraulic fracture into surrounding formation rocks. In a MFHW, such operations are repeated sequentially for each individual hydraulic fracturing stage along the entire wellbore.

In the present examples, the fracture pressure '$P_{frac}$' can be calculated as:

$$P_{frac}=P_S+P_h-P_f \tag{1}$$

Herein, the surface pressure '$P_S$' is measured at the well-head, and the hydrostatic pressure '$P_h$' is calculated as:

$$P_h=\mu gH \tag{2}$$

The friction loss '$P_f$' is a function of surface injection rate '$Q_{inj_s}$' and can be calculated using analytical or numerical models based on the injection fluid properties and wellbore completion design. In addition, rate step-down test (RST), which decreases injection rate step by step instead of stopping pumping instantaneously, can be executed during or at the end of hydraulic fracturing operations to quantify the relationship between '$P_f$' and '$Q_{inj_s}$'.

Generally, when the surface injection rate '$Q_{inj_s}$' is zero, $P_f=0$, then $$P_{frac}=P_S+P_h \tag{3}$$

And, when the surface injection rate '$Q_{inj_s}$' is small and $P_f\approx 0$ or $P_f<<P_S+P_h$, then $$P_{frac}\approx P_S+P_h \tag{4}$$

where '$P_S+P_h$' is equivalent to the bottom-hole pressure when the friction loss is small and negligible. In some cases, the pressure is measured from a downhole pressure gauge installed within a wellbore. Similarly, the fracture pressure can be obtained in the same manner by calculating the corresponding hydrostatic pressure and friction loss.

Figure 3A:
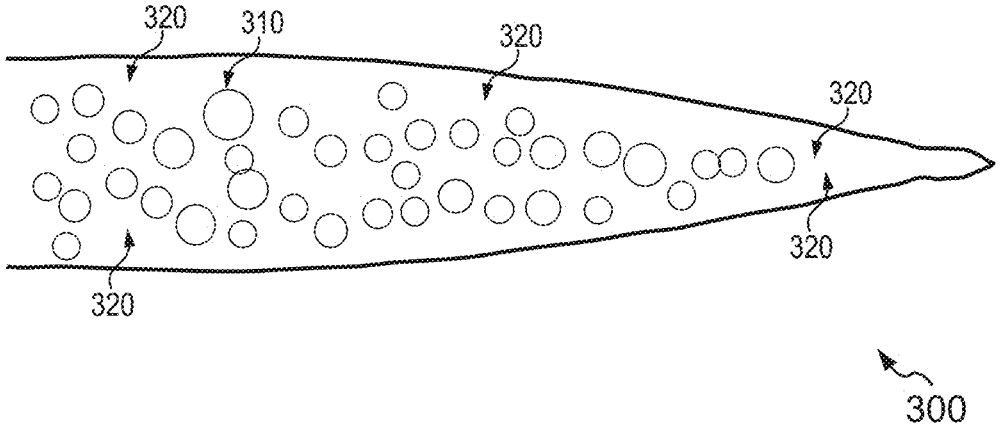
FIGS. 3A and 3B depict schematic illustrations of hydraulic fracture closure after shut-in due to fluid leak-off, in accordance with one or more embodiments of the present disclosure.
Figure 3B:
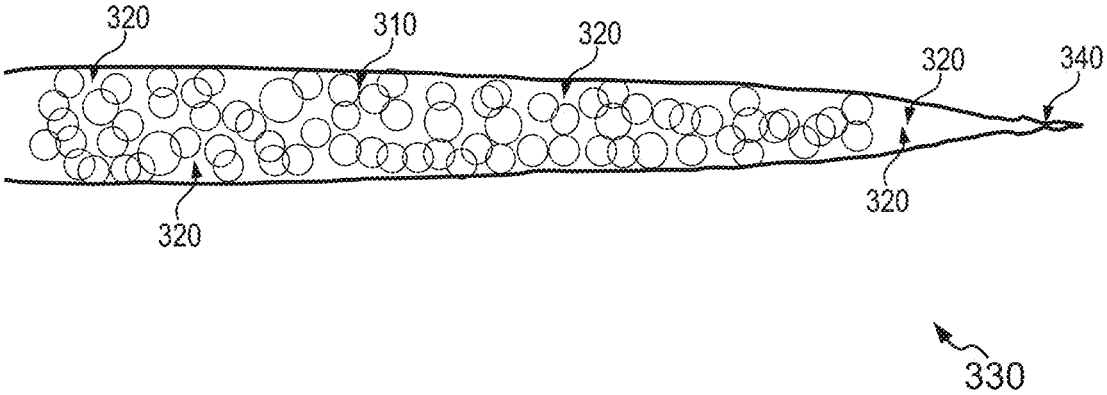

After shut-in of the injection, hydraulic fracture gradually closes as fluid leaks off across the created hydraulic fracture surface into surrounding formation. FIGS. 3A and 3B depict two stages of hydraulic fracture closure after shut-in due to fluid leak-off. Initially, as depicted in FIG. 3A, an open hydraulic fracture 300 is filled with injection fluid 320 that carries proppants 310. As injection fluid 320 leaks off across hydraulic fracture surface into surrounding formation, the pressure inside the open hydraulic fracture 300 continues to decline and eventually, the open hydraulic fracture 300 will close on proppants 310 and rough fracture surfaces 340 to form a closed hydraulic fracture 330 (as depicted in FIG. 3B). It may be appreciated that the time taken for a hydraulic fracture to close on proppants and rough fracture surfaces ranges from tens of minutes to days, depending on formation permeability, injection fluid volume, proppant distribution and fracture surface roughness. Even after hydraulic fracture closes on proppants and rough fracture surfaces, the fluid leak-off process continues across the fracture surface area with declining fracture pressure. If the shut-in time is long enough, the fracture pressure will eventually drop to the formation pore pressure.

Figure 4A:
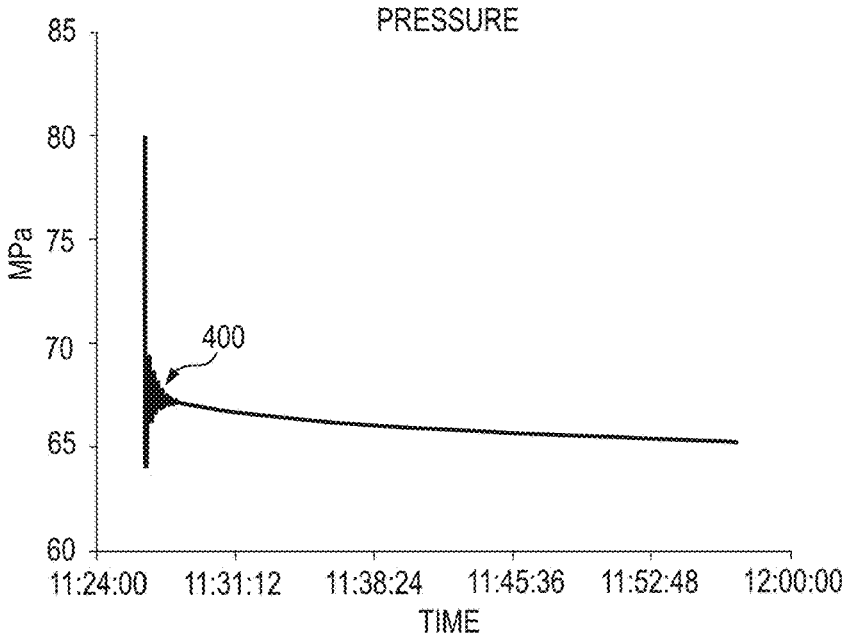
FIGS. 4A and 4B depict graphs representing recorded field data of pressure fall-off within a hydraulic fracturing stage of a MFHW, in accordance with one or more embodiments of the present disclosure.
Figure 4B:
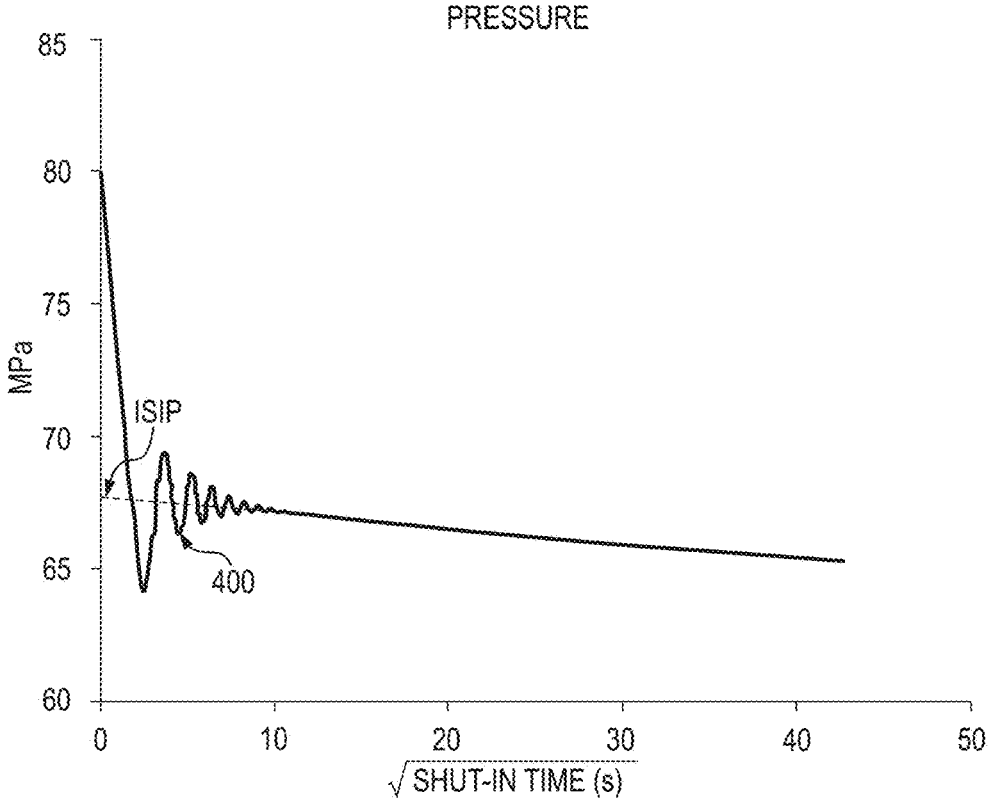

FIGS. 4A-4B depict graphs of recorded field measurement of pressure fall-off data (i.e., pressure decline data) after shut-in within a hydraulic fracturing stage of a MFHW in a shale formation, in accordance with one or more embodiments of the present disclosure. The pressure data is gathered from a pressure gauge that is installed on the wellhead. As can be seen from FIGS. 4A and 4B (plots in FIGS. 4A and 4B exhibit the same data set, only differ in time-related variables of the horizontal axis), the recorded surface pressure declines rapidly in the first few seconds after shut-in due to the dissipation of friction loss, then followed by a water-hammer period (represented by numeral 400) with pressure fluctuations. After the water-hammer period, the pressure declines linearly with the square root of shut-in time. When this linear relationship is established, it signals that the pressure decline inside the hydraulic fracture starting to be controlled by the fluid leak-off process. When this linear portion of data is extrapolated to the shut-in time of '0', the intercept gives instantaneous shut-in pressure (ISIP). It may be understood that without friction loss and water-hammer effect, the recorded pressure would have declined linearly with the square root of shut-in time starting from the ISIP. It may also be appreciated that besides using the square root of shut-in time plot (illustrated in FIG. 4B), there are other techniques (such as G-function plot, log-log plot, etc.) which can also be used to identify ISIP. And, ISIP often reflects the minimum pressure required for stable hydraulic fracture propagation.

It is known that in some low permeability formations, the created hydraulic fracture may continue propagating for some time even after shut-in. This stems from the fact that high friction loss resulting from a high injection rate may lead to significantly higher wellbore pressure than fracture pressure. Even after the pumping stops, fluid in the highly pressurized wellbore continues to flow into the created hydraulic fracture due to a large pressure difference. This phenomenon is often called "fracture tip extension". Depending on the operation, wellbore and formation conditions, fracture tip extension may last a few minutes or more before hydraulic fracture propagation completely stops. In such cases, some wellbore fluid that flowed back after pumping stops can be used to facilitate wellbore depressurization and fracture pressure decline, which can shorten the duration of fracture tip extension or prevent it from occurring. Normally, after the fracture tip extension or water hammer period, the pressure in the wellbore and fracture approaches equilibrium and the bottom-hole pressure equals fracture pressure.

Analyzing pressure fall-off data of closing hydraulic fracture has been practiced for decades in the oil and gas industry. The diagnostic fracture injection test (DFIT, which is also referred to as fracture calibration test, mini-frac test or injection fall-off test) is such an exercise where the pressure fall-off data is analyzed to provide information on closure pressure, fluid efficiency, the existence of natural fractures, formation pore pressure, formation permeability, fracture compliance/stiffness and conductivity. In recent years, the techniques used in DFIT have also been applied to analyze the pressure fall-off data of individual hydraulic fracturing stages of MFHWs, attempting to obtain similar information on hydraulic fracturing parameters and reservoir properties that normally obtained from DFIT. Despite the tremendous value of pressure fall-off analysis (i.e., pressure decline analysis) of individual hydraulic fracturing stages, it cannot be used to quantify hydraulic fracture surface area without making oversimplified or unverifiable assumptions (e.g., fracture does not close on proppants, fracture height is fixed, planar fracture with plane strain conditions, all created hydraulic fractures have the same dimensions within a stage, homogenous rock mechanical properties, etc.), because the total fluid leak-off rate from a closing hydraulic fracture after shut-in cannot be determined from pressure and time data alone. Currently, no cost-effective method is available to estimate the total fluid leak-off rate from a created hydraulic fracture under a specified fracture pressure, especially a method that can determine the variable total fluid leak-off rate over a continuous period of time.

The present disclosure provides a method for determining the total fluid leak-off rate and estimating the corresponding hydraulic fracture surface area by following a desired injection rate and pressure after the hydraulic fracture is created, so that the created hydraulic fracture is neither closing, dilating nor propagating. The injection rate is regulated to ensure that the rate of fluid injected into the created hydraulic fracture equals the total fluid leak-off rate from the created hydraulic fracture so that the created hydraulic fracture maintains its current dimensions with a constant fracture pressure. The surface area of the created hydraulic fracture is then estimated using a fluid leak-off model, wherein the fluid leak-off model provides the relationship between the total fluid leak-off rate and the hydraulic fracture surface area. Once the hydraulic fracture surface area is estimated, the hydraulic fracture volume can further be calculated based on volume balance.

Figure 5:
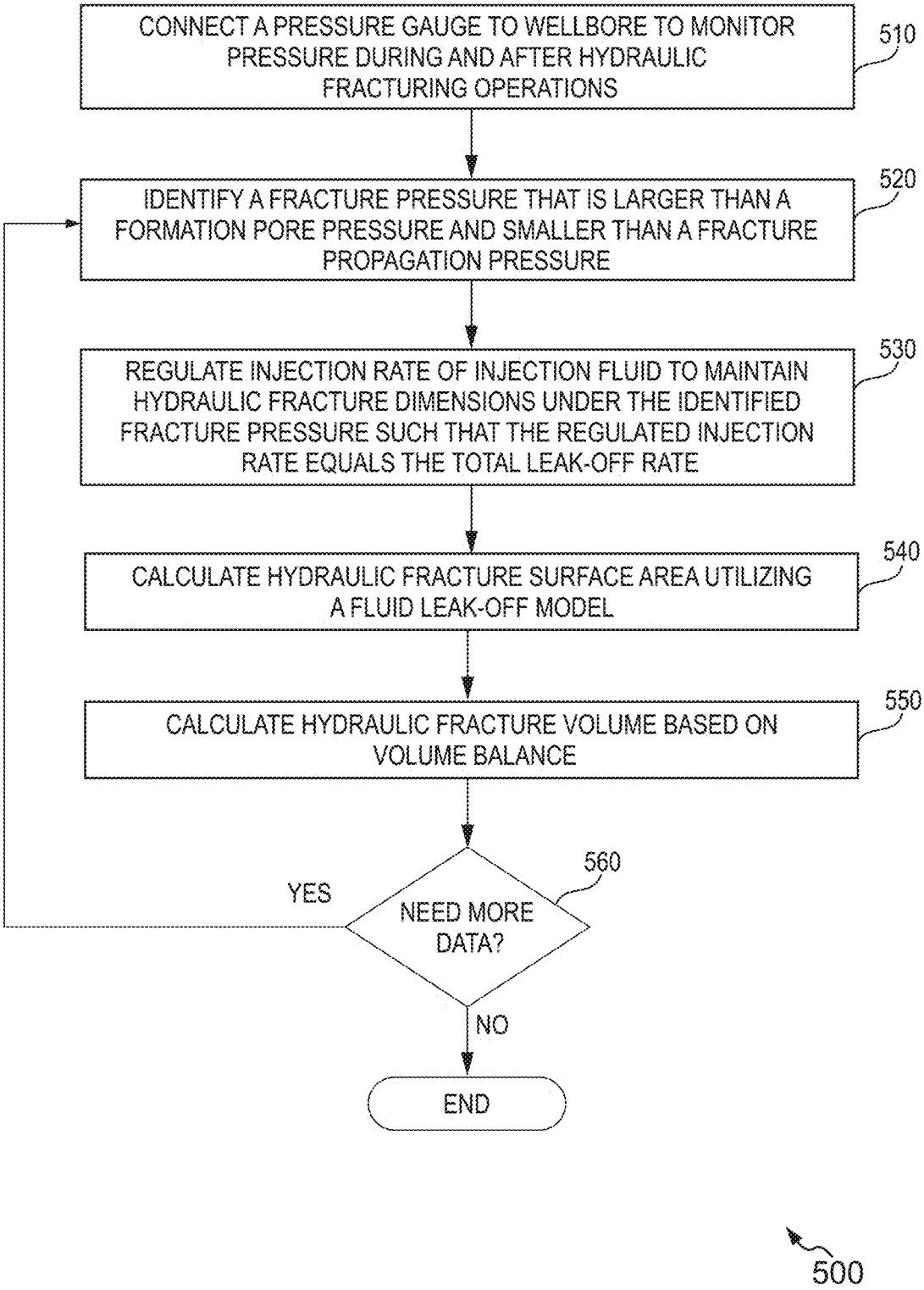
FIG. 5 is an illustration of steps of a method for estimating hydraulic fracture surface area and hydraulic fracture volume, in accordance with one or more embodiments of the present disclosure.

FIG. 5 is an illustration of steps of a method 500 for determining total fluid leak-off rate and estimating the corresponding hydraulic fracture surface area and hydraulic fracture volume that originated from a wellbore, in accordance with one or more embodiments of the present disclosure. In step 510, at least one pressure gauge is connected to the wellbore to monitor the surface or downhole pressure during and after the hydraulic fracturing operations. In one or more embodiments, the pressure gauge is installed at a place that is hydraulically connected to the wellbore, such as installed on a surface pipeline, on a junction of the surface pipeline, or on the wellhead, etc. It can also be installed within the wellbore itself. In step 520, a fracture pressure is identified such that it is larger than a formation pore pressure and smaller than a fracture propagation pressure. Under this identified fracture pressure, the created hydraulic fracture will not propagate further (i.e., no additional hydraulic fracture surface area will be created) because the fracture pressure is smaller than the fracture propagation pressure and fluid will continue leaking off from the created hydraulic fracture into the surrounding formation rocks because the fracture pressure is larger than the formation pore pressure.

The formation pore pressure can be estimated using existing techniques that are commonly practiced in the oil and gas industry, such as using downhole measurement devices, seismic inversion with a mechanical earth model or DFIT, etc. The fracture propagation pressure can be estimated based on ISIP and rock properties. Normally, the fracture propagation pressure is calculated by adding hydrostatic pressure to the ISIP that is measured at the surface. Alternatively, the fracture propagation pressure can be calculated using the well-established theory of fracture mechanics based on in-situ stresses and rock mechanical properties (e.g., Young's modulus, fracture toughness, etc.).

Figure 6:
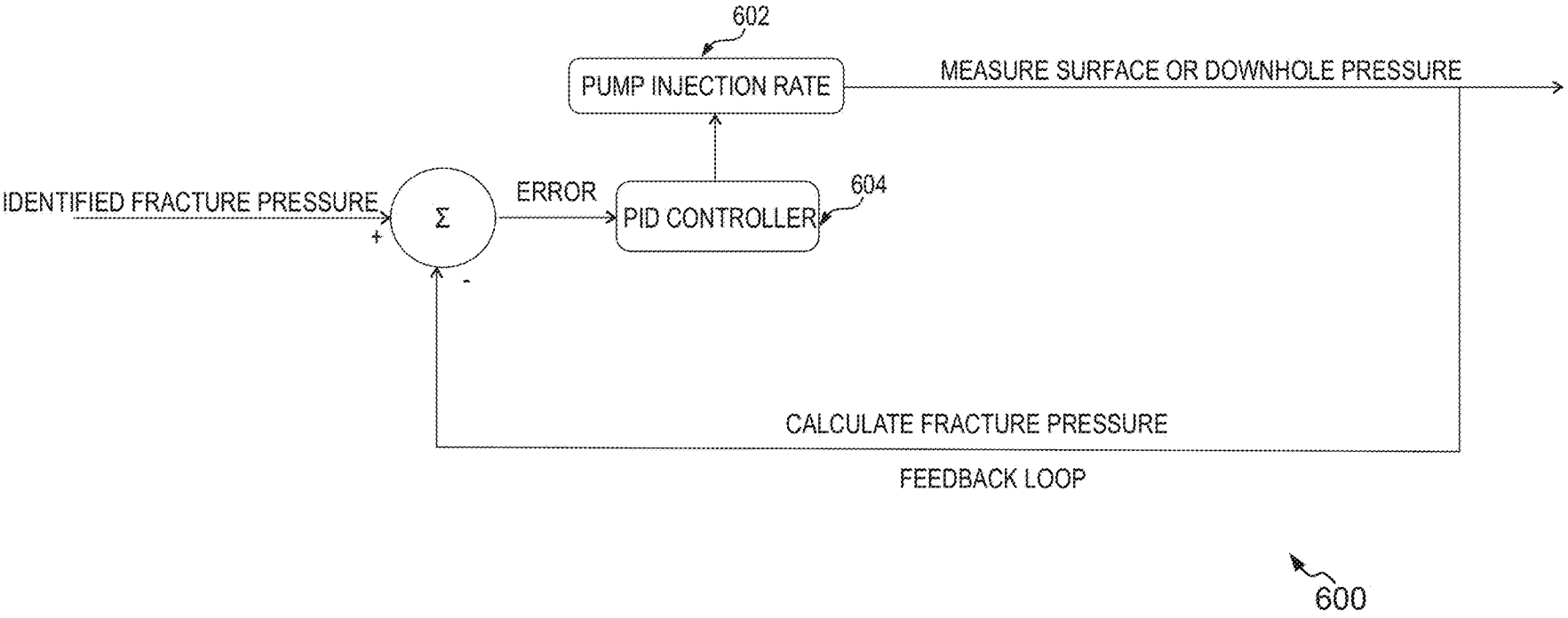
FIG. 6 depicts an exemplary illustration of a block diagram of a circuit maintaining a constant fracture pressure using a PID controller in a feedback loop, in accordance with one or more embodiments of the present disclosure.

In step 530, the dimensions of the created hydraulic fracture are maintained by regulating the injection rate of an injection fluid to the created hydraulic fracture to maintain a constant fracture pressure, wherein the fracture pressure equals the identified fracture pressure in step 520. As long as the fracture pressure remains constant and equals the identified fracture pressure, the hydraulic fracture dimensions remain unchanged. When the hydraulic fracture dimensions are maintained under this constant identified fracture pressure without dilating, propagating, and closing, the volume of fluid stored inside the created hydraulic fracture remains the same, thus from the principle of volume balance, the rate of fluid injected into the created hydraulic fracture should equal the total fluid leak-off rate from the created hydraulic fracture. In one or more embodiments, regulating the injection rate to the created hydraulic fracture is achieved by regulating the injection rate to the wellbore at the surface. In a cased wellbore, there is no fluid loss (i.e., fluid leaks into surrounding formation rocks) along the wellbore. In an open-hole wellbore, the fluid loss along the wellbore is negligible when compared to the fluid loss from the created hydraulic fracture, because the surface area of the hydraulic fracture is often orders of magnitude larger than the internal surface area of an open-hole wellbore, so the regulated surface injection rate to the wellbore can be easily converted to the regulated bottom-hole injection rate to the created hydraulic fracture. Thus, when the dimensions of the created hydraulic fracture are maintained under a constant identified fracture pressure, the total fluid leak-off rate from the created hydraulic fracture equals the regulated bottom-hole injection rate to the created hydraulic fracture. In one or more embodiments, maintaining a constant fracture pressure is achieved by regulating the injection rate of the injection fluid manually. In other embodiments, maintaining a constant fracture pressure is achieved by regulating the injection rate of the injection fluid in real-time via an automatic control system. For example, a proportional-integral-derivative (PID) controller that is widely used in industrial control systems, can constitute a part of the automatic control system. FIG. 6 depicts a schematic illustration of an embodiment of a block diagram of an automatic control system 600 including an injection pump 602 for regulating injection rate of an injection fluid using a PID controller 604 in a feedback loop, such that the fracture pressure is maintained at a constant level and equals an identified fracture pressure.

In one or more embodiments, when the friction loss is small and negligible or the changes in friction loss are small and negligible, according to Eq. (1) and Eq. (4), maintaining a constant fracture pressure can be achieved by regulating the injection rate of an injection fluid to maintain a constant bottom-hole pressure or a constant surface pressure if the hydrostatic pressure remains unchanged. It is to be understood that the hydrostatic pressure normally remains unchanged unless the density of the injection fluid changes.

In step 540, the hydraulic fracture surface area is calculated using a fluid leak-off model after the total fluid leak-off rate from the created hydraulic fracture is determined from the corresponding regulated injection rate in step 530. Herein, the fluid leak-off model provides the relationship between the total fluid leak-off rate and the hydraulic fracture surface area. In this embodiment of step 550, the hydraulic fracture volume is further calculated based on volume balance, wherein the hydraulic fracture volume equals the fluid injection volume received by the created hydraulic fracture minus the total fluid leak-off volume from the created hydraulic fracture. The fluid injection volume received by the created hydraulic fracture can be easily calculated from the fluid injection history. The total fluid leak-off volume can be calculated from a fluid leak-off model for a given hydraulic fracture surface area. In one or more other embodiments of the present invention, step 550 may not be necessary.

In step 560, a determination is made to decide whether more data is needed, and if yes, steps 520-560 may be repeated many times as desired. It is possible that the estimated surface area of the created hydraulic fracture in step 540 changes as the identified fracture pressure in step 520 changes. The present invention only estimates the surface area of the created hydraulic fracture that is hydraulically connected to the wellbore and receives the regulated injection fluid (i.e., injection fluid whose injection rate is regulated to obtain a constant fracture pressure) in step 530. It may be understood that at low fracture pressure (e.g., fracture pressure <minimum in-situ principal stress), some hydraulic fracture surface area, that is not supported by proppants, may be hydraulically disconnected from the wellbore due to damaged conductivity resulting from increased effective stresses. Thus, in one or more embodiments of the present invention, the estimated hydraulic fracture surface area in step 540 may be used to represent the propped hydraulic fracture surface area (i.e., the hydraulic fracture surface area that is supported by proppants). In one or more embodiments of the present invention, the hydraulic fracture surface area may be estimated multiple times under different fracture pressures.

The steps illustrated in FIG. 5 can be applied to the entire section of a wellbore to determine the total fluid leak-off rate and estimate the corresponding hydraulic fracture surface area originated from the wellbore, by introducing the regulated injection fluid to the entire section of the wellbore in step 530. In one example, the regulated injection fluid is introduced to the entire section of a wellbore, wherein multiple hydraulic fracturing stages have been completed and the bridge plugs that isolated each individual hydraulic fracturing stage have been milled out. The steps illustrated in FIG. 5 also can be applied to an isolated section of a wellbore (for example, an isolated section of a wellbore can be, but not limited to, an individual hydraulic fracturing stage), to determine the total fluid leak-off rate and estimating the corresponding hydraulic fracture surface area originated from the isolated section of the wellbore, by only introducing the regulated injection fluid to the isolated section of the wellbore in step 530, wherein the isolated section of the wellbore may contain one or more perforation or perforation clusters. In one example, a wireline is used to set a bridge plug in the wellbore to isolate a section of the wellbore from one or more other sections of the wellbore. In another example, coil tubing is used to set a packer in the wellbore to isolate a section of the wellbore from one or more other sections of the wellbore, wherein the length of the isolated section may be adjusted by moving the packer to a different measured depth along the wellbore.

In case of the wellbore being a multistage hydraulic fractured horizontal well (MFHW), the present method is capable of determining the total fluid leak-off rate and estimating the corresponding hydraulic fracture surface area of individual hydraulic fracturing stages by separately introducing the steps depicted in FIG. 5 for each stage. For MFHWs, there is often a gap period between successive hydraulic fracturing stages when no operation is executed in the wellbore. This gap period is needed for personnel and equipment preparation (e.g., assemble perforation guns and bridge plug) for the next hydraulic fracturing stage, and normally ranges from 30 minutes to over an hour. If step 530 in FIG. 5 is executed during this gap period, then the normal procedure of hydraulic fracturing operations will not be impacted at all, this is one of the biggest advantages of the present invention. The estimated hydraulic fracture surface area of each individual hydraulic fracturing stage can further be used as input parameters for a production model or a reservoir simulator to predict the final production rate from each individual hydraulic fracturing stages.

In one or more embodiments, the step 520 and step 530 in FIG. 5 are merged into a single step, wherein the fracture pressure under which the fracture dimensions are maintained is identified in real-time, as long as the identified fracture pressure is larger than the formation pore pressure and smaller than the fracture propagation pressure. In one embodiment, the total fluid leak-off rate is determined at two intentionally specified fracture pressures (e.g., one is 0.5 MPa above the closure pressure and the other is 0.5 MPa below the closure pressure) to quantify the impact of fracture closure on total fluid leak-off rate. Normally, the fracture pressure drops below fracture propagation pressure soon after the end of water hammer or fracture tip extension period, and it may take days, or even weeks for the fracture pressure to drop to the formation pore pressure if flow-back is not executed. This gives substantial flexibility on when the total fluid leak-off rate can be determined. For example, a constant fracture pressure and the associated total fluid leak-off rate can be obtained right after the water hammer or fracture tip extension period with proper real-time regulated injection rate if field condition only permits short operating time in step 530 of FIG. 5. One advantage of the present invention is that it is capable of determining the total fluid leak-off rate at any desired fracture pressure or at any desired time after the creation and extension of hydraulic fracture, as long as the fracture pressure is larger than the formation pore pressure and smaller than the fracture propagation pressure.

A preferred method of determining the total fluid leak-off rate from step 530 in FIG. 5 is to maintain a constant fracture pressure over a continuous period of time. In low permeability formations, fracture pressure declines very slowly after the end of water hammer or fracture tip extension period, and the decline rate of fracture pressure also decreases over time as the pressure gradient in the adjacent formation rocks declines. Therefore, in low permeability formations, especially when certain time has elapsed since the end of water hammer or fracture tip extension period, it is difficult to determine whether the fracture pressure is truly maintained at a constant level or the fracture pressure is just declining at a very slow rate if it is only attempted to maintain a constant fracture pressure for a very brief moment. For example, if $Q_{inj}$ is the required regulated injection rate to maintain a constant fracture pressure, $Q_{inj}/2$ may lead to a fracture pressure that looks like it is maintained at a constant level for a very brief moment. Thus, attempt to maintain a constant fracture pressure for a very brief moment may lead to inaccurate estimation of the total fluid leak-off rate. Instead, maintaining a constant fracture pressure over a continuous period of time can ensure the fracture pressure is indeed maintained at a constant level and reduces the uncertainties and errors in the estimation of the total fluid leak-off rate. When the continuous period of time is adequate, the changes in total fluid leak-off rate during the continuous period of time can also be determined. The changes in total fluid leak-off rate during the continuous period of time provide other valuable information on fracture propagation rate, effectiveness of limited entry completion, formation permeability, and the interference of nearby wells, etc. This valuable information that is derived from the changes in total fluid leak-off rate over the continuous period of time can also be used to calibrate the fluid leak-off model and reduce the uncertainties or errors in the estimation of hydraulic fracture surface area in step 540 of FIG. 5.

In one embodiment, the fluid leak-off model used in step 540 of FIG. 5 is an analytical leak-off model, wherein the total leak-off rate '$Q_l$' across hydraulic fracture surface area '$A_f$', after the end of hydraulic fracture creation and extension and before hydraulic fracture closes on proppants, can be calculated as:

$$Q_l = \frac{2 f_p C_l A_f}{\sqrt{t_0}} f(t_D) \tag{5}$$

herein, the total leak-off coefficient '$C_l$' is a lumped parameter that depicts how fast fluid can leak-off from the hydraulic fracture into surrounding formation rocks and it is controlled by the properties of injection fluid, in-situ fluid and formation rock properties. The total leak-off coefficient '$C_l$' is also called Carter's leak-off coefficient and has been widely used in the oil and gas industry since the advent of hydraulic fracturing modeling. The value of '$C_l$' is often determined by lab experiment, numerical simulation or DFIT. In general, the higher the formation permeability, the larger is the value of '$C_l$'. Further, '$f_p$' is the ratio of leak-off hydraulic fracture surface area to total hydraulic fracture surface area. In conventional reservoirs, $f_p=1$ for a fracture contained perfectly in the permeable layer and $f_p<1$ if the fracture grows out from the permeable layer. When $f_p<1$, '$f_p$' can be approximated by the ratio of the total thickness of permeable layers to the height of the hydraulic fracture. In unconventional reservoirs, all hydraulic fracture surface areas are considered to subject to leak-off and $f_p=1$.

The dimensionless loss-rate function '$f(t_D)$' is determined by the growth rate of fracture surface area extension during hydraulic fracture creation and extension. Herein, the dimensionless loss-rate function '$f(t_D)$' can be evaluated by an upper and lower bound:

$$2\left[(1+t_D)^{\frac{1}{2}} - t_{D}^{\frac{1}{2}}\right] > f(t_D) > \sin^{-1}(1+t_D)^{-\frac{1}{2}} \tag{6}$$

herein '$t_D$' is a dimensionless time, with $$t_D = \frac{t - t_0}{t_0} = \frac{\Delta t}{t_0} \tag{7}$$

where '$t_0$' is the total pumping time during the creation and extension of the hydraulic fracture.

Herein, the upper bound assumed fluid leak-off is negligible during hydraulic fracture creation and extension and the lower bound assumed fluid leak-off is significant, and the hydraulic fracture volume is negligible when compared to the total leak-off volume. Normally, the upper bound reflects most of the cases in unconventional reservoirs with low permeability and the lower bound reflects scenarios in conventional reservoirs with high permeability. Even though the process of hydraulic fracture propagation in low and high permeability formations is not explicitly modelled, the impact of hydraulic fracture propagation on leak-off rate after the end of hydraulic fracture propagation is reflected implicitly by the upper and lower bounds of the dimensionless loss-rate function '$f(t_D)$'.

Figure 7:
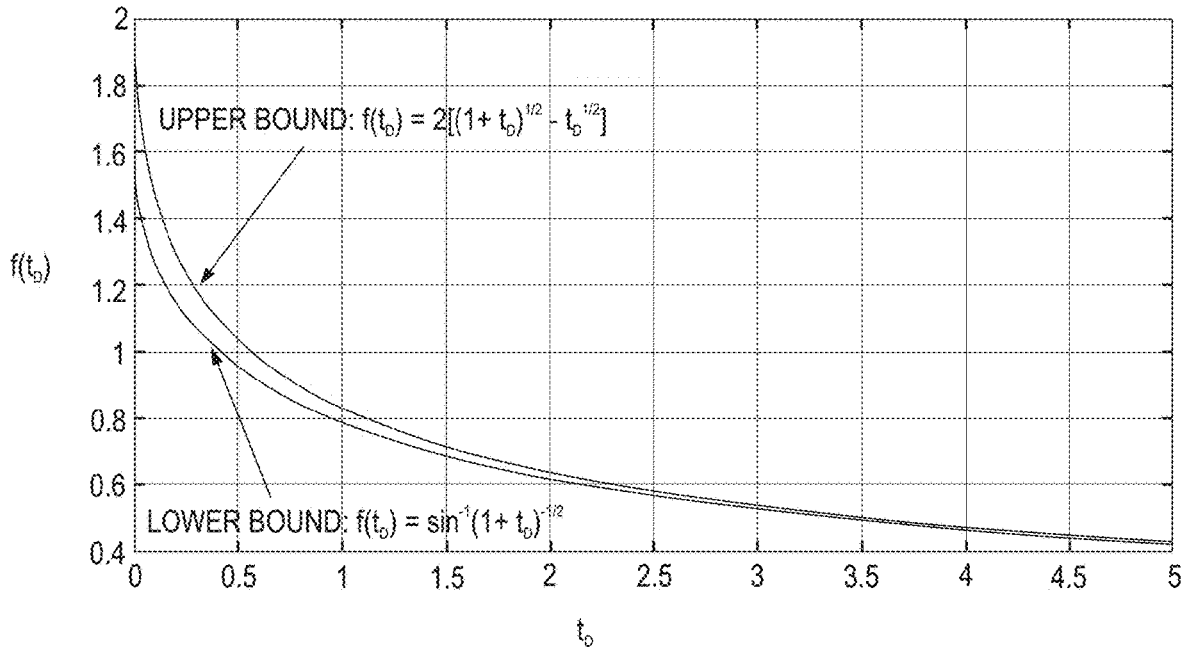
FIG. 7 depicts a graph representing upper and lower bounds of the dimensionless loss-rate function '$f(t_D)$', in accordance with one or more embodiments of the present disclosure.

FIG. 7 depicts an embodiment of the upper and lower bounds of the dimensionless loss-rate function '$f(t_D)$' as a function of '$t_D$'. The dimensionless loss-rate function '$f(t_D)$' is bound within a narrow range, and as '$t_D$' increases with longer elapsed time '$\Delta t$', the difference between the upper and lower bounds diminishes.

To estimate the hydraulic fracture surface area '$A_f$' from the analytical leak-off model of Eq. (5) or any other leak-off model, the total leak-off rate '$Q_l$' within a certain time period has to be determined first. However, the pressure fall-off data during shut-in does not give direct information on the total leak-off rate '$Q_l$'.

As stated in step 530 of FIG. 5, the fracture pressure '$P_{frac}$' remains constant and satisfies the conditions such that it is larger than the formation pore pressure and smaller than the fracture propagation pressure, the created hydraulic fracture maintains its current dimensions and will neither close, dilate nor propagate, and the total volume of injection fluid stored in the created hydraulic fracture remains unchanged. Based on volume balance, the bottom-hole injection rate '$Q_{inj}$' has to compensate for the total leak-off rate '$Q_l$' and under such a scenario:

$$Q_{inj} = Q_1 \tag{8}$$

If $Q_{inj}<Q_l$, the hydraulic fracture will close with declining fracture pressure. If $Q_{inj}>Q_l$, the hydraulic fracture will dilate with increasing fracture pressure and eventually propagate once the fracture pressure reaches the fracture propagation pressure. In other words, as long as the fracture pressure is maintained at a constant level that is larger than the formation pore pressure and smaller than the fracture propagation pressure, the rate of fluid injected into the created hydraulic fracture has to equal the total fluid leak-off rate from the created hydraulic fracture.

By assuming no fluid loss along a cased wellbore and the fluid loss along an open-hole wellbore is negligible, the bottom-hole injection rate '$Q_{inj}$' can be calculated from the surface injection rate '$Q_{inj_s}$' by using injection fluid volume factor 'B' that accounts for the compressibility of the injection fluid, as follows:

$$Q_{inj}=BQ_{inj_s} \tag{9}$$

Normally, the injection fluid is liquid and has very small compressibility with B≈1.

Figure 8:
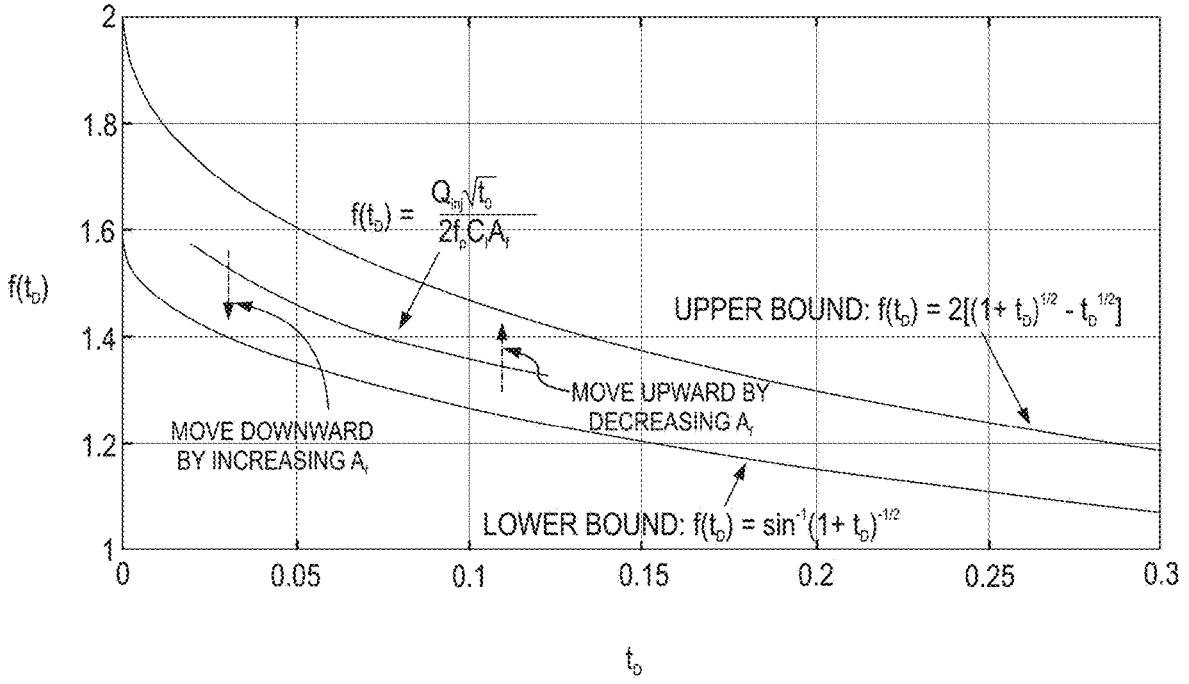
FIG. 8 depicts an exemplary graph for estimating hydraulic fracture surface area '$A_f$' by calculating the real dimensionless loss-rate function '$f(t_D)$' that is constrained by its upper and lower bounds, in accordance with one or more embodiments of the present disclosure.

When the bottom-hole injection rate '$Q_{inj}$' equals the total leak-off rate '$Q_l$' under a constant fracture pressure, the analytical leak-off model of Eq. (5) can be re-arranged to calculate the real dimensionless loss-rate function $f(t_D)$:

$$f(t_D)=\frac{Q_{inj}\sqrt{t_0}}{2f_pC_lA_f} \tag{10}$$

wherein, the hydraulic fracture surface area '$A_f$' is estimated by adjusting value thereof so that the calculated '$f(t_D)$' satisfies: $2[(1+t_D)^{1/2}-t_D^{1/2}]>f(t_D)>\sin^{-1}(1+t_D)^{-1/2}$, or by fitting the calculated '$f(t_D)$' to match one or more of $2[(1+t_D)^{1/2}-t_D^{1/2}]$ and $\sin^{-1}(1+t_D)^{-1/2}$ It may be contemplated by a person skilled in the art that since the dimensionless loss-rate function '$f(t_D)$' has its upper and lower bounds, the hydraulic fracture surface area '$A_f$' has to be within a certain range so that the calculated '$f(t_D)$' using Eq. (10) falls within the upper and lower bounds that are described in Eq. (6). FIG. 8 depicts an exemplary graph for estimating hydraulic fracture surface area '$A_f$' by calculating the real dimensionless loss-rate function '$f(t_D)$', in accordance with one or more embodiments of the present disclosure. As can be seen, the curve of the calculated dimensionless loss-rate function '$f(t_D)$' moves upward with decreasing hydraulic fracture surface area '$A_f$', and moves downward with increasing hydraulic fracture surface area '$A_f$'. The range of hydraulic fracture surface area '$A_f$' is estimated by adjusting its value so that calculated dimensionless loss-rate function '$f(t_D)$' is within its upper and lower bounds. As '$t_D$' increases, the difference between the upper and lower bounds becomes narrower, so does the range of the estimated hydraulic fracture surface area '$A_f$'. In one or more embodiments, the product of $C_lA_f$ as a whole can be estimated by the same manner if the total leak-off coefficient '$C_l$' is not known. When the real dimensionless loss-rate function '$f(t_D)$' is calculated over a continuous period of time (based on the estimated leak-off rate over the continuous period of time), its decline rate may be used to infer the formation permeability: if its decline rate is closer to that of the upper bound, the formation may have a low permeability, and if the decline rate is closer to that of the lower bound, the formation may have a high permeability.

In one or more embodiments, the analytical fluid leak-off model is further utilized to calculate the hydraulic fracture volume. In one embodiment, knowing the hydraulic fracture surface area '$A_f$', the total leak-off coefficient '$C_l$' and the pumping time '$t_0$' during hydraulic fracture creation and extension, a total leak-off volume '$V_l$' at the end of hydraulic fracture propagation can be estimated by an upper and lower bound. Specifically, the total leak-off volume '$V_l$' at the end of the hydraulic fracture creation and extension is estimated by:

$$\frac{8}{3}C_lf_pA_f\sqrt{t_0}<V_l<\pi C_lf_pA_f\sqrt{t_0} \tag{11}$$

In general, for a given fluid leak-off model, the total leak-off volume '$V_l$' can be calculated by integrating the fluid leak-off model with respect to the estimated hydraulic fracture surface area over a period of time. The total injection volume '$V_{inj}$' received by the created hydraulic fracture can be determined based on the measured injection rate history, and the hydraulic fracture volume '$V_f$' can be estimated by volume balance:

$$V_f=V_{inj}-V_l \tag{12}$$

In one embodiment, the analytical fluid leak-off model of Eq. (5) used in step 540 of FIG. 5 is replaced by another analytical fluid leak-off model. In one embodiment, the fluid leak-off model used in step 540 of FIG. 5 is a semi-analytical fluid leak-off model. In other embodiments, the fluid leak-off model used in step 540 of FIG. 5 is a numerical fluid leak-off model that is able to calculate the total fluid leak-off rate during and after hydraulic fracture creation and extension. In one or more embodiments, the numerical fluid leak-off model is a standalone model. In other embodiments, the numerical leak-off model includes a hydraulic fracture propagation simulator and/or a reservoir simulator, wherein the leak-off rate does not necessarily need to be calculated using a leak-off coefficient. In one or more embodiments, the numerical fluid leak-off model includes or is coupled with a wellbore fluid flow model. In one or more embodiments, the numerical fluid leak-off model includes the coupling of a wellbore model, a hydraulic fracture propagation model and a reservoir model, wherein hydraulic fracture propagation and fluid leak-off behavior in multiple formation layers can be simulated. In one or more embodiments, the numerical fluid leak-off model is capable of calculating fluid leak-off rate during and after hydraulic fracture creation and extension with single-phase or multi-phase flow at different fracture pressures. In one or more embodiments, the numerical fluid leak-off model may also be capable of calculating the total fluid leak-off rate after the hydraulic fracture closes on proppants and rough fracture walls. In one or more embodiments, the numerical fluid leak-off model may be used in conjunction with other numerical models to include the effect of reservoir heterogeneity and the interference from nearby wells. In one or more embodiments, the numerical fluid leak-off model solves a system of equations for hydraulic fracture propagation and fluid flow within the hydraulic fracture and fluid flow inside the surrounding formation using a numerical method, which includes, but is not limited to, finite element method, finite volume method, finite difference method and boundary element method. In one or more embodiments, the numerical fluid leak-off model can have an analytical or semi-analytical part. For example, a numerical fluid leak-off model can use an analytical model for hydraulic fracture propagation while solves a system of equations for fluid flow inside the hydraulic fracture using a finite difference method and solves a system of equations for fluid flow inside the surrounding formation using a finite volume method. When a numerical fluid leak-off model is used, the hydraulic fracture surface area '$A_f$' is estimated by a history matching process, that is, adjusting the value of '$A_f$' or other input parameters of the numerical fluid leak-off model that determine the value of '$A_f$', such that the simulated total leak-off rate '$Q_l$' from the numerical fluid leak-off model equals or matches the rate of fluid injected into the created hydraulic fracture '$Q_{inj}$' when the hydraulic fracture maintains its dimensions under a constant fracture pressure. This history matching process can be also applied to an analytical fluid leak-off model or a semi-analytical fluid leak-off model to estimate the hydraulic fracture surface area.

In one or more embodiments, the value of an input parameter in a fluid leak-off model can be assumed with the best knowledge if it is not known in advance. For example, the ranges of the hydraulic fracture surface area can be estimated by assuming the value range of the leak-off coefficient or formation permeability used in a fluid leak-off model, wherein the fluid leak-off model can be an analytical fluid leak-off model, a semi-analytical fluid leak-off model or a numerical fluid leak-off model.

Simulation Example

Figure 9A:
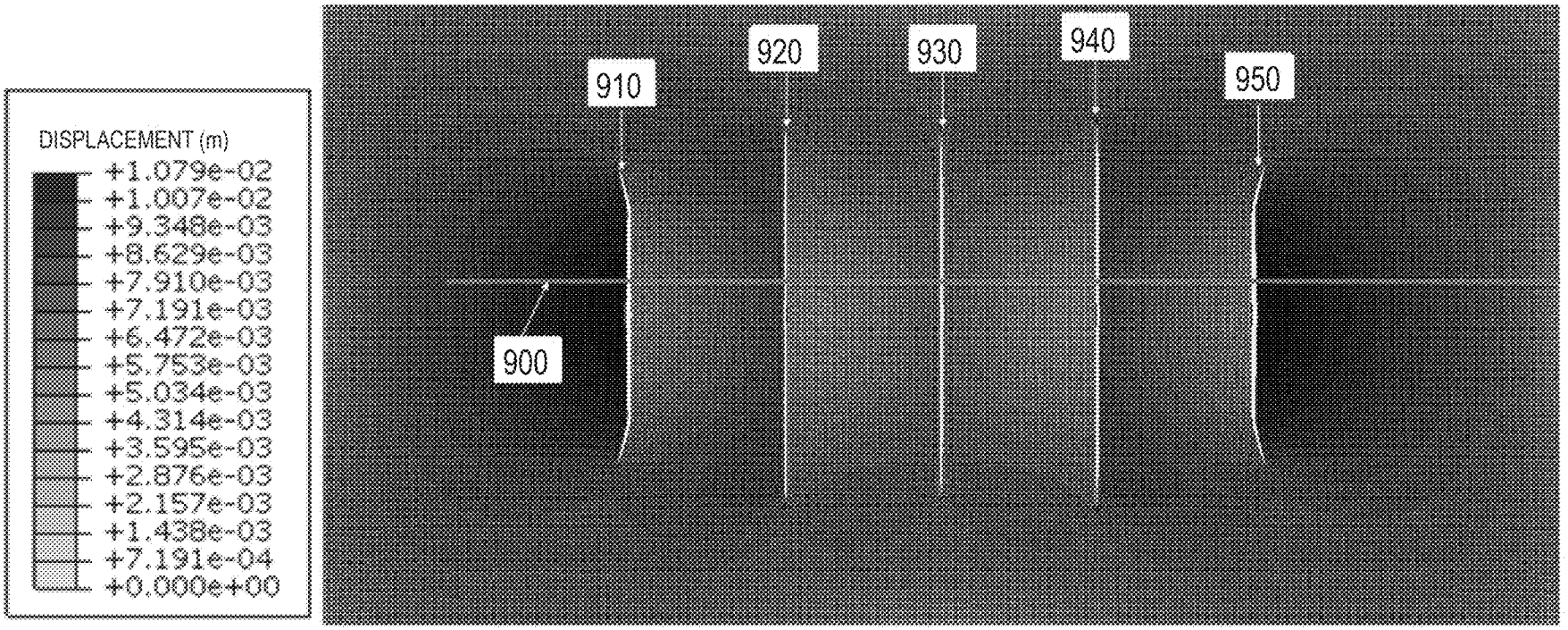
FIG. 9A depicts a graph representing a numerically simulated displacement contour of multiple hydraulic fracture propagation within a hydraulic fracturing stage, in accordance with one or more embodiments of the present disclosure.
Figure 9B:
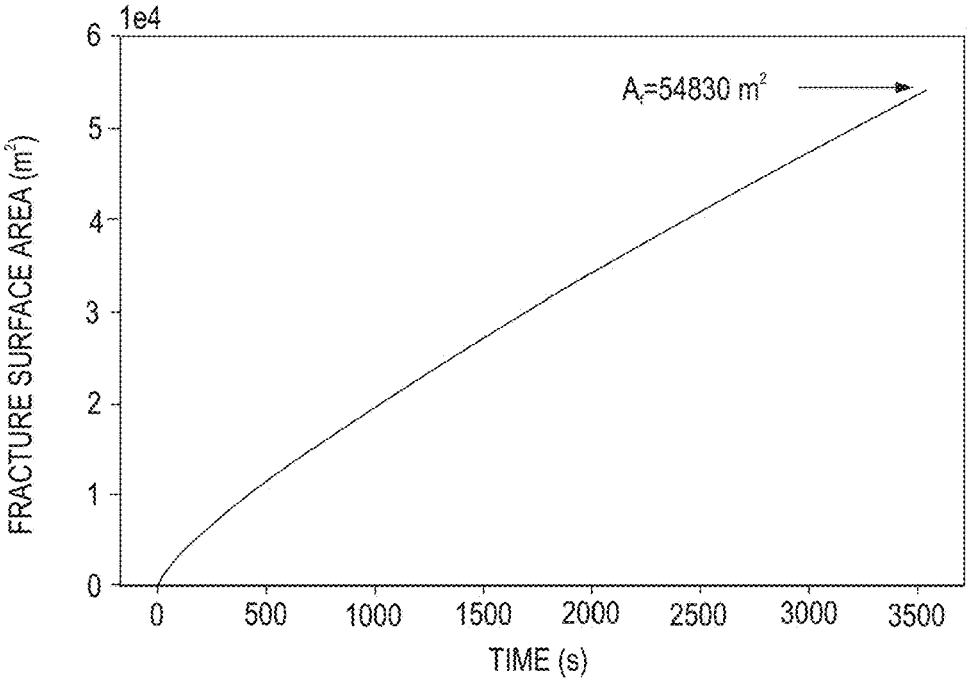
FIG. 9B depicts a graph representing a numerically simulated total surface area growth of multiple hydraulic fractures within a hydraulic fracturing stage, in accordance with one or more embodiments of the present disclosure.
Figure 9C:
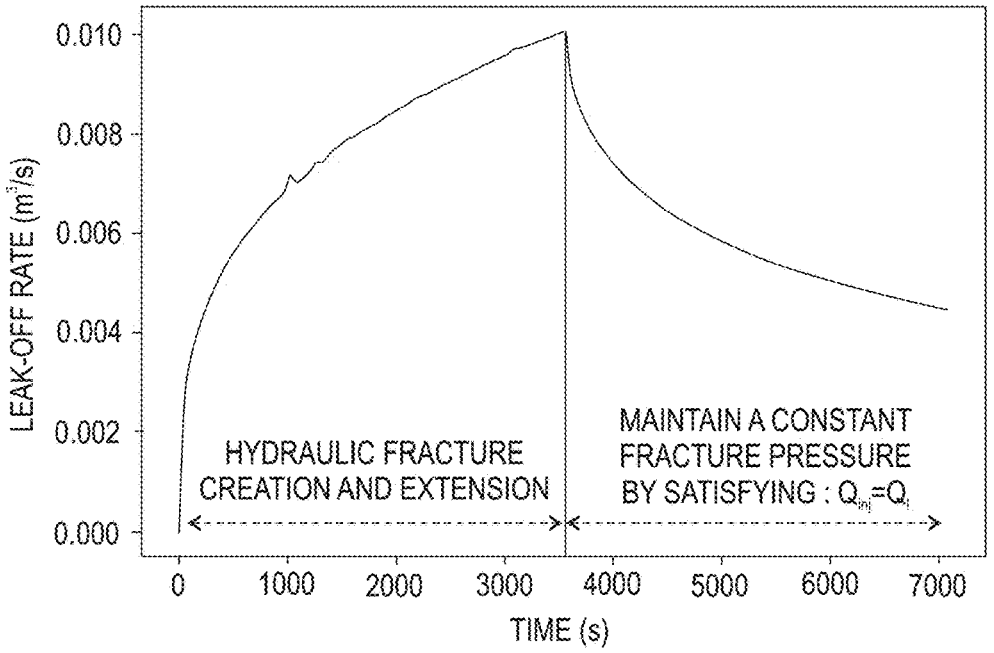
FIG. 9C depicts a graph representing a numerically simulated total leak-off rate of multiple hydraulic fractures within a hydraulic fracturing stage, in accordance with one or more embodiments of the present disclosure.
Figure 9D:
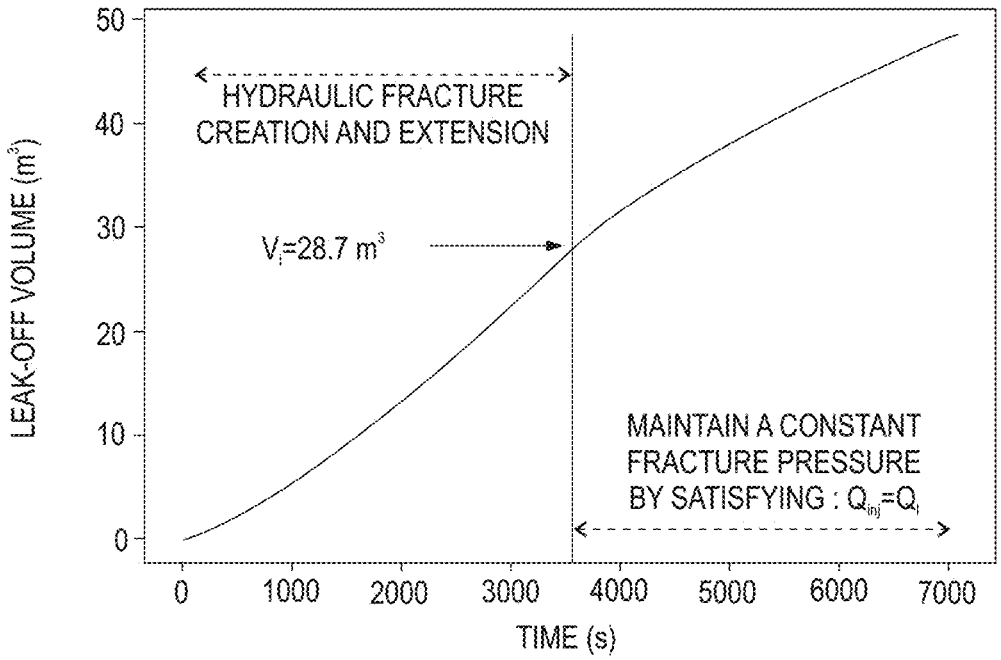
FIG. 9D depicts a graph representing a numerically simulated total leak-off volume of multiple hydraulic fractures within a hydraulic fracturing stage, in accordance with one or more embodiments of the present disclosure.

The present example uses a fully-coupled finite element model to simulate hydraulic fracture propagation and fluid leak-off behavior within a hydraulic fracturing stage of a MFHW in a single layer formation. FIG. 9A depicts the simulated displacement contour at the end of hydraulic fracture creation and extension. The scale of the visualization of simulated displacement in FIG. 9A is enlarged to render a better observation of the hydraulic fracture geometry and rock deformations. In the simulation, water is pumped into a cased horizontal wellbore 900 at a constant injection rate of 0.15 $m^3/s$ for 1 hour with five simultaneously propagating hydraulic fractures 910, 920, 930, 940, 950 and then the fracture pressure is maintained at a constant level for a continuous period of time by regulating the injection rate equals the total leak-off rate with fixed fracture dimensions. The input total leak-off coefficient '$C_l$' is 3e-6 m/√s and the total injection volume '$V_{inj}$' is 0.15 $m^3/s \times 3600$ s=540 $m^3$. FIG. 9B shows the growth of simulated total hydraulic fracture surface area (i.e., total hydraulic fracture surface area of hydraulic fractures 910, 920, 930, 940, 950 in FIG. 9A) during the 1-hour pumping, and the final total hydraulic fracture surface area '$A_f$' is 54830 $m^2$. FIG. 9C shows the simulated total leak-off rate during and after hydraulic fracture creation and extension. As can be seen, in order to maintain a constant fracture pressure for a continuous period of time after hydraulic fracture creation and extension, the regulated injection rate has to decrease gradually. The regulated injection rate decreases almost 25% just in the first 400 s (i.e., from 3600 s to 4000 s) after the end of hydraulic fracture creation and extension. FIG. 9D shows the simulated total leak volume during and after hydraulic fracture creation and extension by integrating the total leak-off rate over hydraulic fracture surface area. At the end of hydraulic fracture creation and extension, the total leak-off volume '$V_l$' is 28.7 $m^3$, and based on volume balance of Eq. (12), the simulated total hydraulic fracture volume '$V_f$' at the end of hydraulic fracture creation and extension is 540 $m^3$−28.7 $m^3$=511.3 $m^3$.

Figure 10:
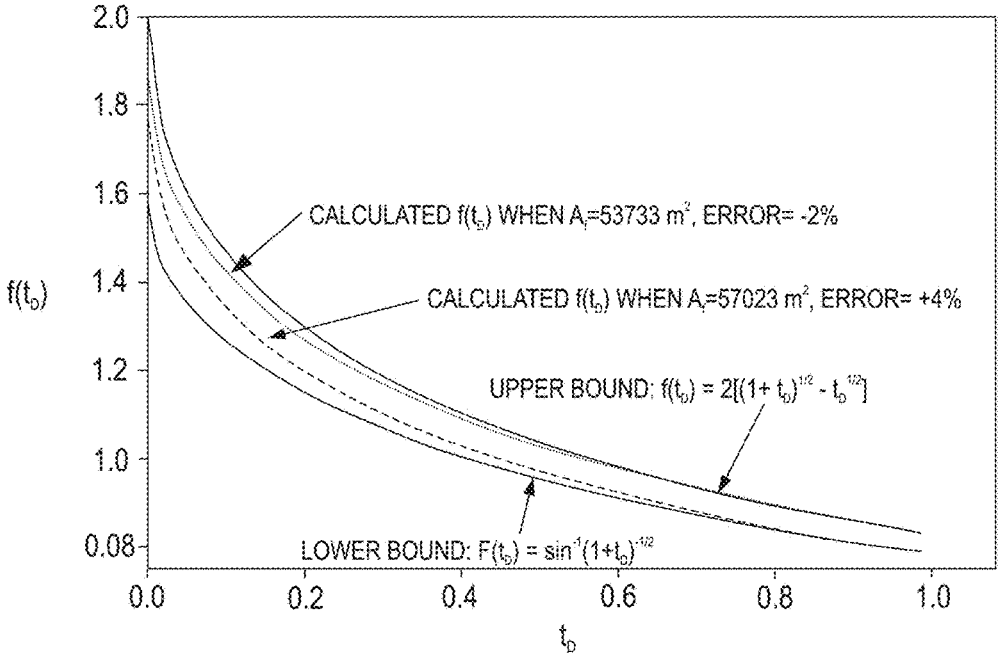
FIG. 10 depicts a graph for estimating hydraulic fracture area using an analytical leak-off model and numerical simulation data, in accordance with one or more embodiments of the present disclosure.

Knowing the pumping time '$t_0$'=3600 s, 'fp'=1 for single formation layer, and the regulated injection rate to the created hydraulic fracture '$Q_{inj}$' after the end of fracture creation and extension from FIG. 9C when the fracture dimensions are maintained under a constant fracture during a continuous period of time, the real dimensionless loss-rate function '$f(t_D)$' during the continuous period of time can be calculated using Eq. (10) by adjusting the value of estimated hydraulic fracture surface area '$A_f$', as shown in FIG. 10. To ensure the calculated dimensionless loss-rate function '$f(t_D)$' is bound by the upper and lower bounds, the estimated hydraulic fracture surface area has to satisfy: 53733 $m^2 < A_f < 57023$ $m^2$, which only gives a maximum of 4% error when compared with the simulated final hydraulic fracture surface area of 54830 $m^2$. After the hydraulic fracture surface area is estimated, using Eq. (11) and Eq. (12) to estimate hydraulic fracture volume at the end of fracture creation and extension leads to: 508 $m^3 < V_f < 514$ $m^3$, which only gives a maximum of 0.5% error when compared with the simulated total hydraulic fracture volume of 511.3 $m^3$ at the end of hydraulic fracture creation and extension.

Field Experiment

Figure 11:
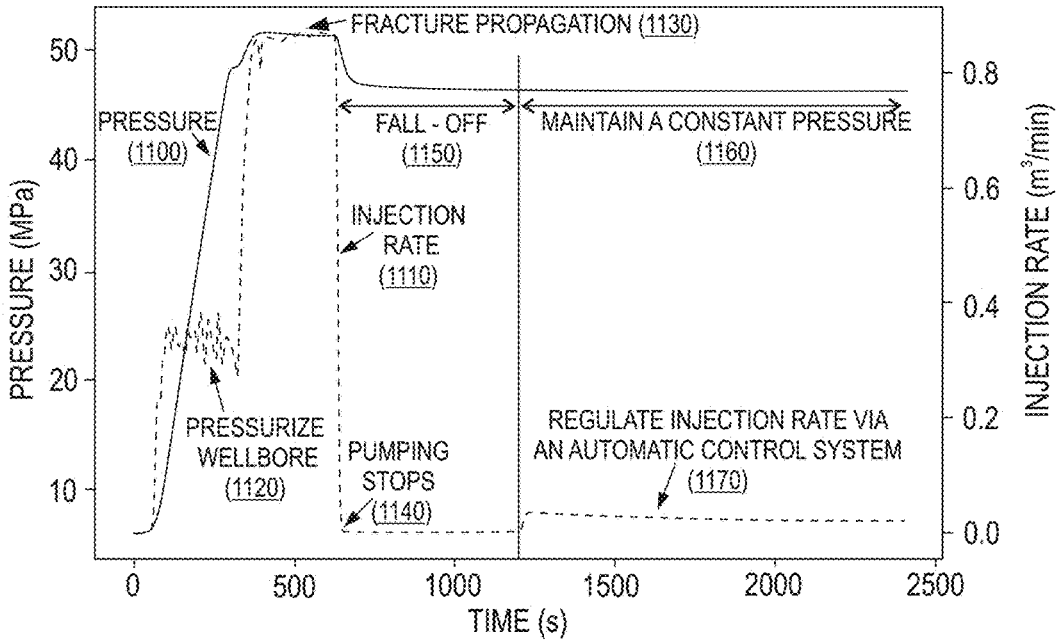
FIG. 11 depicts a graph representing recorded field data of pressure and injection rate for a field experimental test, in accordance with one or more embodiments of the present disclosure.

A field experimental test is executed in a cased wellbore with a single perforation cluster in a naturally fractured shale formation. Previous analysis of DFIT data of nearby wells indicates that the formation pore pressure is 60 MPa and the total leak-off coefficient '$C_l$' is 5e-6 m/√s. The recorded surface pressure (represented by the solid line 1100 in FIG. 11) and surface injection rate (represented by the dashed line 1110 in in FIG. 11) data are shown in FIG. 11. Initially, the wellbore is pressurized with a small surface injection rate 1120 until the formation rock breaks down (i.e., fracture initiation), then a total of 3.52 $m^3$ water is pumped during hydraulic fracture propagation 1130. After the end of pumping 1140, the well is shut-in, and the pressure falls off for a while 1150. Finally, water is re-injected into the wellbore via an automated control system to maintain the surface pressure at a constant level of 46.2 MPa for a continuous period of time 1160. Under such a small regulated injection rate 1170, the associated friction loss is negligible, and the injection fluid density remains unchanged during this period 1160, so maintaining a constant surface pressure is equivalent to maintaining a constant bottom-hole pressure and a constant fracture pressure. The calculated hydrostatic pressure of injected water column from the surface to the perforation cluster is 30 MPa, the ISIP is identified at 48 MPa from the analysis of pressure data during the fall-off period 1150, so the estimated fracture propagation pressure is 78 MPa (i.e., ISIP of 48 MPa plus hydrostatic pressure of 30 MPa). The fracture pressure is maintained at a constant level of 76.2 MPa (i.e., surface pressure of 46.2 MPa plus hydrostatic pressure of 30 MPa) during the period 1160, which is larger than the formation pore pressure of 60 MPa and smaller than the fracture propagation pressure of 78 MPa. Thus, during this period 1160, the rate of fluid injected to the created hydraulic fracture equals the total leak-off rate from the created hydraulic fracture, and the created hydraulic fracture maintains its dimensions without closing, dilating or propagating. Because no fluid loss occurs along this cased wellbore and the compressibility of injected water is negligible, so the regulated injection rate to the wellbore at the surface equals the regulated bottom-hole injection rate to the created hydraulic fracture, that is $Q_{inj_s}=Q_{inj}$, during the period 1160.

Figure 12:
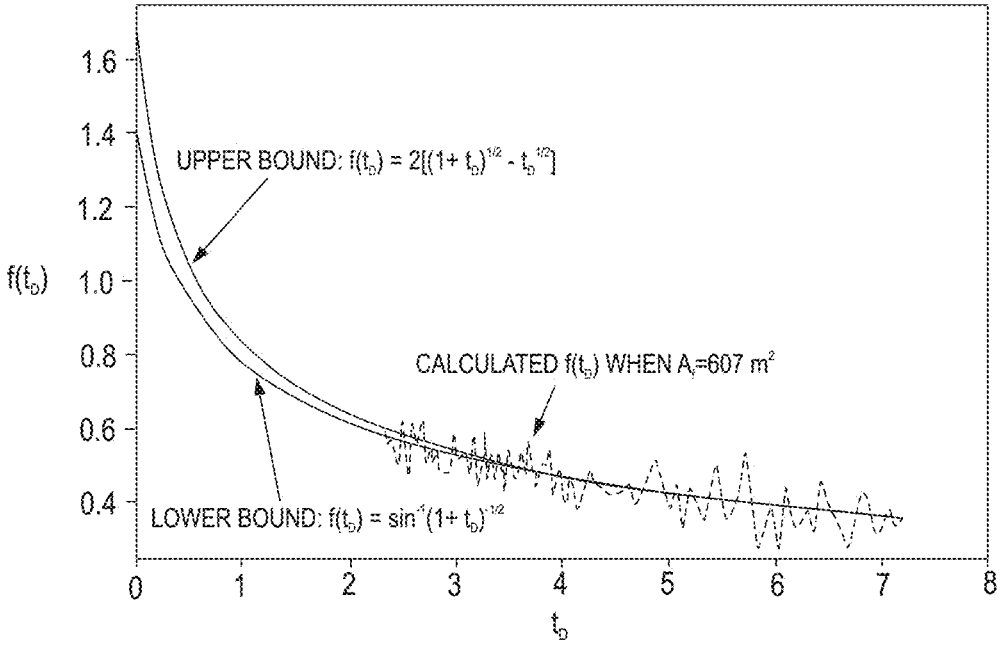
FIG. 12 depicts a graph for estimating hydraulic fracture surface area using an analytical leak-off model and field data, in accordance with one or more embodiments of the present disclosure.

Knowing the pumping time '$t_0$'=246 s, '$f_p$'=1 for shale formation, and the rate of fluid injected into the created hydraulic fracture '$Q_{inj}$' when the surface pressure is maintained at a constant level during the continuous period 1160, the real dimensionless loss-rate function '$f(t_D)$' can be calculated using Eq. (10) by adjusting the value of estimated hydraulic fracture surface area '$A_f$', as shown in FIG. 12. In this particular embodiment, the dimensionless time '$t_D$' is large enough so that the lower and upper bounds of '$f(t_D)$' almost converge, and the noise in the regulated injection rate data leads to fluctuations in the calculated real dimensionless loss-rate function '$f(t_D)$'. The curve of the calculated real dimensionless loss-rate function '$f(t_D)$' (represented by the dashed line in FIG. 12) moves up and down when the hydraulic fracture surface area '$A_f$' is adjusted, and the hydraulic fracture surface area '$A_f$' is estimated when the best fit is found between the calculated '$f(t_D)$' and that predicted by its lower and upper bounds. After trial and error, an estimation of $A_f$=607 $m^2$ yields the best fit. To make the best fit, the hydraulic fracture surface area '$A_f$' may be adjusted manually through each calculation or via optimization algorithms (e.g., the method of least squares). In other embodiments, improved automatic control system (including, but not limited to, improved PID algorithm, improved resolution of pressure gauge and flow meter, etc.) or data filter techniques may be implemented to reduce or eliminate the noise and fluctuation in the regulated injection rate and maintain a more stable fracture pressure. After the hydraulic fracture surface area '$A_f$' is estimated, using Eq. (11) and Eq. (12) to estimate hydraulic fracture volume '$V_f$' at the end of hydraulic fracture creation and extension leads to: 3.36 $m^3 < V_f < 3.39\ m^3$.

Figure 13A:
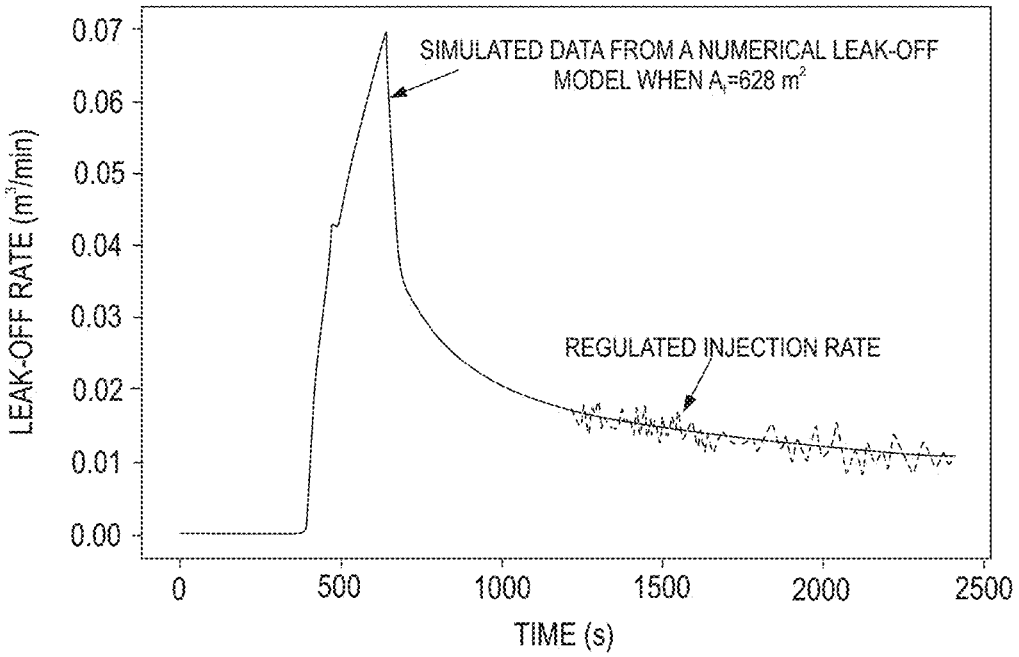
FIG. 13A depicts a graph for estimating hydraulic fracture surface area using a numerical leak-off model and field data, in accordance with one or more embodiments of the present disclosure.
Figure 13B:
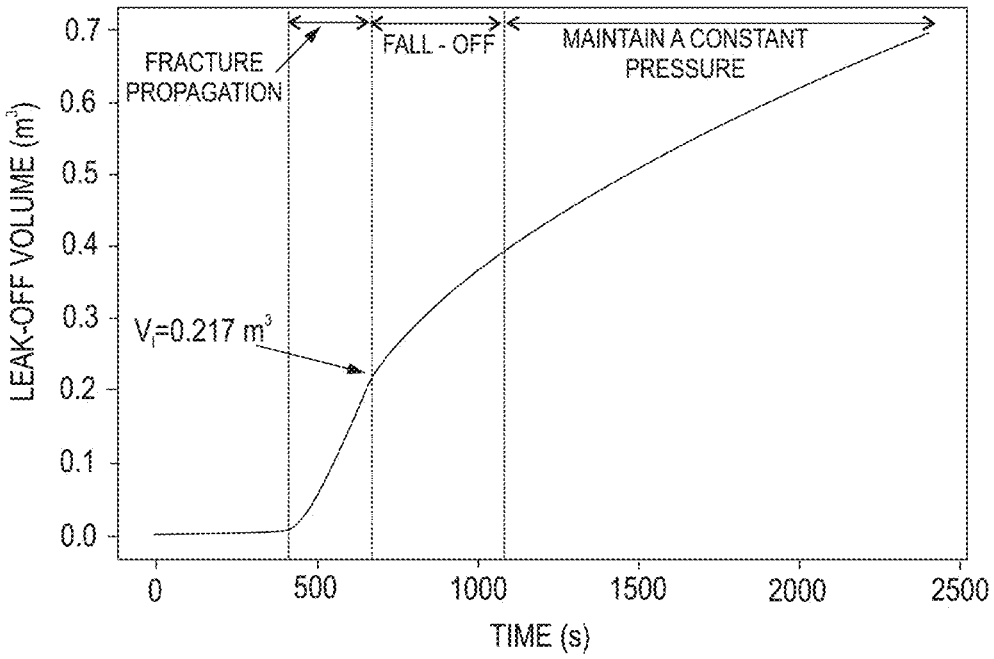
FIG. 13B depicts a graph for estimating total leak-off volume using a calibrated numerical leak-off model, in accordance with one or more embodiments of the present disclosure.

Besides using the analytic leak-off model of Eq. (5), a numerical leak-off model is set up to simulate fluid leak-off behavior during and after hydraulic fracture propagation. This numerical leak-off model includes a hydraulic fracture propagation model. By adjusting the hydraulic fracture propagation criterion or rock mechanical properties, the resulting simulated hydraulic fracture surface area varies, and so does the corresponding fluid leak-off rate. Using trial and error approach, the best match (during the period 1160 in FIG. 11 when the fracture pressure is maintained at a constant level) between the simulated total leak-off rate (represented by the solid line in FIG. 13A) and the regulated rate of fluid injected into the created hydraulic fracture (represented by the dashed line in FIG. 13A) is when '$A_f$'=628 $m^2$, as shown in FIG. 13A. As can be seen, in order to maintain a constant fracture pressure during the continuous period of time (i.e., during the period 1160 in FIG. 11), the regulated injection rate has to decrease gradually and by integrating the total leak-off rate over the hydraulic fracture surface area, the corresponding simulated total leak-off volume can be calculated and is shown in FIG. 13B. The simulated total leak-off volume $V_l$=0.217 $m^3$ at the end of hydraulic fracture creation and extension, and by using Eq. (12) of volume balance, the corresponding hydraulic fracture volume $V_f$=3.52 $m^3$-0.217 $m^3$=3.303 $m^3$.

It may be contemplated by a person skilled in the art that the estimated hydraulic fracture surface area from an analytical leak-off model and a numerical leak-off model may be different, because an analytical leak-off model may inherent some assumptions that a numerical leak-off model does not necessarily need. For example, one assumption of the analytical leak-off model, as provided by Eq. (5), is the fracture pressure during and after the hydraulic fracture creation and extension changes little. This assumption is appropriate under some circumstances, but may lead to large errors under other circumstances. In general, a numerical leak-off model is often capable of simulating fluid leak-off behavior under complicated operation conditions with varying fracture pressure history and/or variable pumping rate, thus have a wider range of applications.

Figure 14:
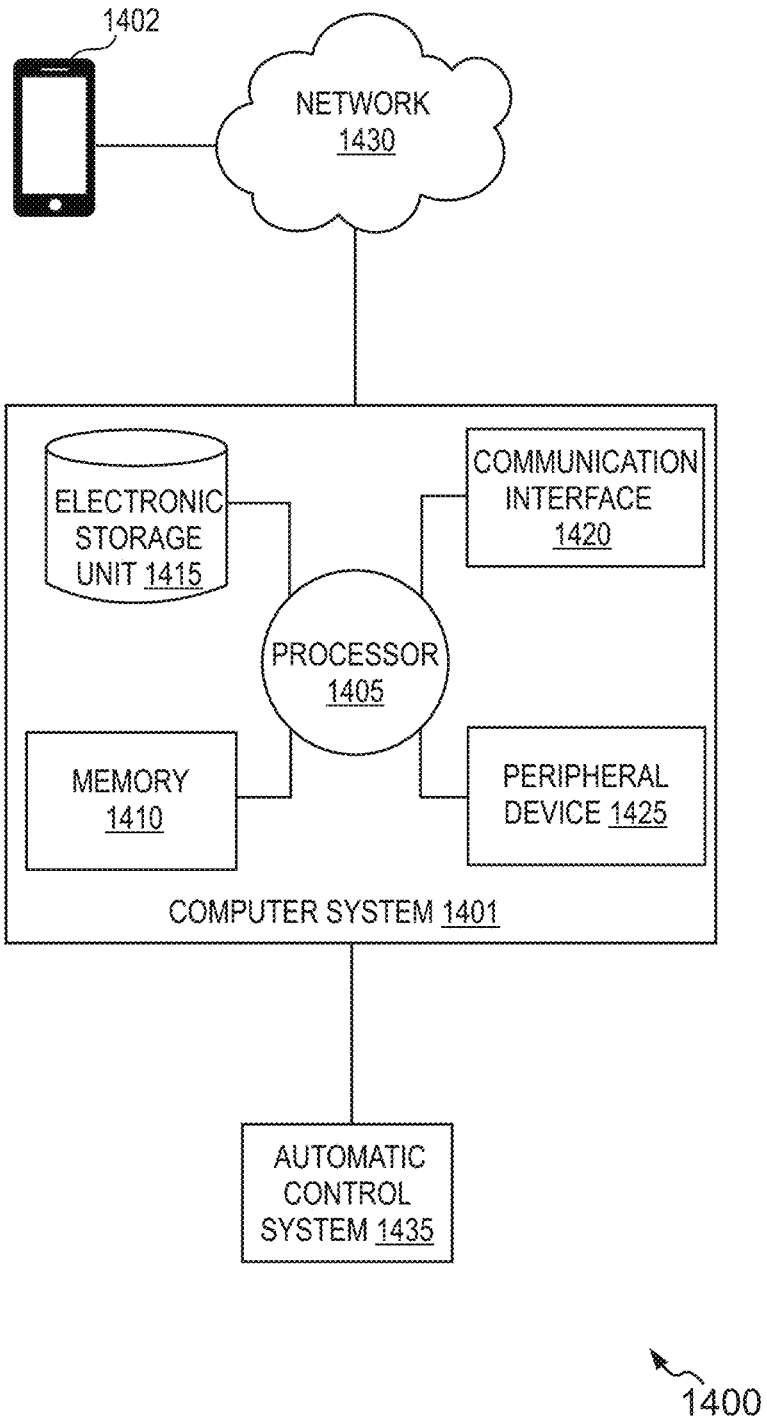
FIG. 14 depicts an exemplary illustration of a block diagram of a system for estimating hydraulic fracture surface area, in accordance with one or more embodiments of the present disclosure.

FIG. 14 is a block diagram of a system 1400 for estimating hydraulic fracture surface area, in accordance with one or more embodiments of the present disclosure. The system 1400 may include a data processing arrangement 1401 (hereinafter, simply referred to as computer system 1401) that is programmed or otherwise configured to implement modeling and simulating fluid leak-off behaviors during and/or after hydraulic fracture creation and extension. The computer system 1401 may be an electronic device of a user or a computer system that is remotely located with respect to the electronic device. The electronic device may be a mobile electronic device. The computer system 1401 may include a central processing unit (CPU, also "processor" and "computer processor" herein) 1405, which may be a single core or multi-core processor. In an example, the central processing unit 1405 comprises a plurality of processors for parallel processing. The computer system 1401 may receive data from the wellbore or surface facilities (e.g., either from a user or via an upload from sensors or data logs), use the data to regulate injection rate of an injection fluid to maintain a constant fracture pressure and process a fluid leak-off model to calculate the hydraulic fracture surface area. The computer system 1401 may also use the data to generate a model of the wellbore, hydraulic fracture and reservoir, calibrate the model by comparing the model solution of the total leak-off rate to the rate of fluid injected into the created hydraulic fracture under a constant fracture pressure, solve the calibrated model to generate simulation data, and display the simulation results to a user (e.g., via a display). The computer system 1401 may also include a data storing arrangement 1410 (also referred to as memory or memory location 1410), and include random-access memory, read-only memory, flash memory, etc.), electronic storage unit 1415 (e.g., hard disk), communication interface 1420 (e.g., network adapter) for communication with one or more other systems, and peripheral devices 1425, such as cache, other memory, data storage and/or electronic display adapters. The memory 1410, electronic storage unit 1415, communication interface 1420, and peripheral devices 1425 may be in communication with the CPU 1405 through a communication bus (solid lines), such as a motherboard. The electronic storage unit 1415 may be a database (or data repository) for storing variable assigned or updated variables used in a fluid leak-off model. Additionally, the memory or storage unit may store raw data, calculated data, one or more components of the model, one or more components of the calibrated model, and/or model simulation outputs (e.g., summary tables, graphical representations of the results, and/or specific outputs). The computer system 1401 may be operatively coupled to a computer network ("network") 1430 with the aid of the communication interface 1420. The network 1430 may be the Internet, and internet and/or extranet, or an intranet and/or extranet that is in communication with the Internet. The network 1430 may be, in some cases, a telecommunication and/or data network. The network 1430 may include one or more computer servers, which may enable distributed computing, such as cloud computing. The network may be in communication with one or more sensors, data logs, or database such that the computer system can access data from the sensor, data logs, or database. The network 1430, in some cases with the aid of the computer system 1401, may implement a peer-to-peer network, which may enable devices coupled to the computer system 1401 to behave as a client or a server. The network may facilitate mobile electronic devices 1402 to access the simulated and raw data, including, but not limited to, measured pressure and injection rate data, calculated and stored variables and parameters of the fluid leak-off model, estimated hydraulic fracture surface area and associated leak-off rate.

The CPU 1405 can be part of a circuit, such as an integrated circuit. One or more other components of the computer system 1401 can be included in the circuit. In some cases, the circuit is an application specific integrated circuit (ASIC). The electronic storage unit 1415 can store files, such as drivers, libraries and saved programs. The electronic storage unit 1415 can store user data, e.g., user preferences and user programs. The computer system 1401 in some cases can include one or more additional data storage units that are external to the computer system 1401, such as located on a remote server that is in communication with the computer system 1401 through an intranet or the Internet.

The computer system 1401 can communicate with one or more remote computer systems through the network 1430. For instance, the computer system 1401 can communicate with a remote computer system of a user (e.g., a mobile electronic device). Examples of remote computer systems include personal computers (e.g., portable PC), slate or tablet PC's (e.g., Apple® iPad, Samsung® Galaxy Tab), telephones, Smart phones (e.g., Apple® iPhone, Android-enabled device, Blackberry®), or personal digital assistants. The user can access the computer system 1401 via the network 1430.

Methods as described herein can be implemented by way of machine (e.g., computer processor) executable code stored on an electronic storage location of the computer system 1401, such as, for example, on the memory 1410 or electronic storage unit 1415. The machine executable or machine readable code can be provided in the form of software. During use, the code can be executed by the processor 1405. In some cases, the code can be retrieved from the electronic storage unit 1415 and stored on the memory 1410 for ready access by the processor 1405. In some situations, the electronic storage unit 1415 can be precluded, and machine-executable instructions are stored on memory 1410. The code can be pre-compiled and configured for use with a machine having a processer adapted to execute the code, or can be compiled during runtime. The code can be supplied in a programming language that can be selected to enable the code to execute in a pre-compiled or as-compiled fashion.

Aspects of the systems and methods provided herein, such as the steps illustrated in FIG. 5, can be embodied in programming, such as a non-transitory computer-program product having computer-readable instructions stored therein that, when executed by a processor, cause the processor to perform method steps. Various aspects of the technology may be thought of as "products" or "articles of manufacture" typically in the form of machine (or processor) executable code and/or associated data that is carried on or embodied in a type of machine readable medium. Machine-executable code can be stored on an electronic storage unit, such as memory (e.g., read-only memory, random-access memory, flash memory) or a hard disk. "Storage" type media can include any or all of the tangible memory of the computers, processors or the like, or associated modules thereof, such as various semiconductor memories, tape drives, disk drives and the like, which may provide non-transitory storage at any time for the software programming. All or portions of the software may at times be communicated through the Internet or various other telecommunication networks. Such communications, for example, may enable loading of the software from one computer or processor into another, for example, from a management server or host computer into the computer platform of an application server. Other type of media that may bear the software elements includes optical, electrical and electromagnetic waves, such as used across physical interfaces between local devices, through wired and optical landline networks and over various air-links. The physical elements that carry such waves, such as wired or wireless links, optical links or the like, also may be considered as media bearing the software. As used herein, the term machine "readable medium" refer to any medium that participates in providing instructions to a processor for execution.

Hence, a machine readable medium, such as computer-executable code, may take many forms, including but not limited to, a tangible storage medium, a carrier wave medium or physical transmission medium. Tangible transmission media include coaxial cables; copper wire and fiber optics, including the wires that comprise a bus within a computer system. Carrier-wave transmission media may take the form of electric or electromagnetic signals, or acoustic or light waves such as those generated during radio frequency (RF) and infrared (IR) data communications. Common forms of computer-readable media therefore include for example: a floppy disk, a flexible disk, hard disk, magnetic tape, any other magnetic medium, a CD-ROM, DVD or DVD-ROM, any other optical medium, punch cards paper tape, any other physical storage medium with patterns of holes, a RAM, a ROM, a PROM and EPROM, a FLASH-EPROM, any other memory chip or cartridge, a carrier wave transporting data or instructions, cables or links transporting such a carrier wave, or any other medium from which a computer may read programming code and/or data. Many of these forms of computer readable media may be involved in carrying one or more sequences of one or more instructions to a processor for execution.

The system 1400 further includes an automatic control system 1435. The automatic control system 1435 includes a pressure gauge configured to monitor pressure during and after hydraulic fracture creation and extension in the wellbore. Herein, the pressure gauge is installed on at least one of: a surface pipeline connecting to the wellbore, a junction of the surface pipeline, a wellhead of the wellbore and within the wellbore. The automatic control system 1435 also includes a fluid injection device (e.g., an injection pump) configured to inject fluid to a created hydraulic fracture. Further, the automatic control system 1435 includes a controller, such as a proportional-integral-derivative (PID) controller to regulate the injection rate of the injection fluid to maintain a constant fracture pressure. In one example, the PID controller may be implemented in a feedback loop (as discussed in FIG. 6). The automatic control system 1435 may be configured to perform various computer-implemented functions including, but not limited to, performing proportional integral derivative ("PID") control algorithms, including various calculations within one or more PID control loops, and various other suitable computer-implemented functions. In addition, the automatic control system 1435 may also include various input/output channels for receiving inputs from sensors and/or other measurement devices (such as, for example, from the pressure gauge connected to the wellbore) and for sending control signals to various components (such as, for example, to send control signals to the injection pump to regulate injection rate of the injection fluid). The automatic control system 1435 may be a singular controller or include various components, which communicate with a central controller for specifically controlling the injection rate as discussed. Additionally, the term "controller" may also encompass a combination of computers, processing units and/or related components in communication with one another.

Methods and systems of the present disclosure can be implemented by way of one or more algorithms. The method can be implemented by way of software upon execution by the central processing unit 1405. The method can, for example, direct the computer memory to store and update variables used in a fluid leak-off model. The method may regulate the injection rate of an injection fluid to a wellbore to maintain a constant fracture pressure. The method may solve the fluid leak-off model to simulate the fluid leak-off rate during and after hydraulic fracture creation and extension. The method may estimate hydraulic fracture surface area by calibrating the fluid leak-off model to make the simulated leak-off rate equals the rate of fluid injected into the created hydraulic fracture under a constant fracture pressure. The method may generate plots that represent the simulation results and may display the plots on an electronic display.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the present disclosure and various embodiments with various modifications as are suited to the particular use contemplated.

What is claimed is:

1. A method for determining total fluid leak-off rate from a created closed hydraulic fracture that originated from a wellbore, the method comprising:

monitoring pressure in the wellbore after creation and extension of the created closed hydraulic fracture; and regulating injection rate of an injection fluid to the created closed hydraulic fracture to maintain a constant fracture pressure for a continuous period of time, such that the created closed hydraulic fracture maintains its current dimensions and the injection rate of the injection fluid into the created closed hydraulic fracture equals the total fluid leak-off rate from the created closed hydraulic fracture, wherein the constant fracture pressure is larger than a formation pore pressure and smaller than a fracture closure pressure.

2. The method as claimed in claim 1 further comprising estimating the formation pore pressure and the fracture closure pressure.

3. The method as claimed in claim 1, wherein regulating the injection rate of the injection fluid to the created closed hydraulic fracture is achieved by regulating the injection rate of the injection fluid to the wellbore.

4. The method as claimed in claim 1, wherein the total fluid leak-off rate from the created closed hydraulic fracture that originated from an entire section of the wellbore is determined by introducing the regulated injection fluid to the entire section of the wellbore.

5. The method as claimed in claim 1, wherein the total fluid leak-off rate from the created closed hydraulic fracture that originated from an isolated section of the wellbore is determined by introducing the regulated injection fluid to the isolated section of the wellbore.

6. The method as claimed in claim 1, wherein flow-back is executed to facilitate a decline of fracture pressure.

7. The method as claimed in claim 1, wherein a rate step-down test (RST) is executed to quantify relationship between the injection rate and friction loss.

8. The method as claimed in claim 1, wherein the injection rate of the injection fluid is regulated manually or regulated by an automatic control system.

9. The method as claimed in claim 1, wherein maintaining the constant fracture pressure is achieved by regulating the injection rate of the injection fluid such that a bottom-hole pressure or a surface pressure is maintained at a constant level.

10. A method for estimating surface area of a created hydraulic fracture that originated—from a wellbore, the method comprising:

monitoring pressure in the wellbore during and after creation and extension of the created hydraulic fracture;

regulating injection rate of an injection fluid to the created hydraulic fracture to maintain a constant fracture pressure, such that the created hydraulic fracture maintains its current dimensions and the injection rate of the injection fluid into the created hydraulic fracture equals the total fluid leak-off rate from the created hydraulic fracture, wherein the constant fracture pressure is larger than a formation pore pressure and smaller than a fracture propagation pressure; and utilizing a numerical fluid leak-off model to estimate the surface area of the created hydraulic fracture, wherein the numerical fluid leak-off model performs numerical simulation to obtain the relationship between the total fluid leak-off rate and the surface area of the created hydraulic fracture, and wherein the numerical fluid leak-off model comprises a coupling of a wellbore model, a hydraulic fracture propagation model, and a reservoir model to solve a system of equations for hydraulic fracture propagation and fluid flow within the hydraulic fracture and fluid flow inside the surrounding formation using at least one of: a finite element method, a finite volume method, a finite difference method, and a boundary element method.

11. The method as claimed in claim 10 further comprising estimating the formation pore pressure and the fracture propagation pressure.

12. The method as claimed in claim 10, wherein regulating the injection rate of the injection fluid to the created hydraulic fracture is achieved by regulating the injection rate of the injection fluid to the wellbore.

13. The method as claimed in claim 10, wherein the total fluid leak-off rate from the created hydraulic fracture that originated from entire section of the wellbore and the surface area of the created hydraulic fracture that originated from the entire section of the wellbore are determined by introducing the regulated injection fluid to the entire section of the wellbore.

14. The method as claimed in claim 10, wherein the total fluid leak-off rate from the created hydraulic fracture that originated from an isolated section of the wellbore and the surface area of the created hydraulic fracture that originated from the isolated section of the wellbore are determined by introducing the regulated injection fluid to the isolated section of the wellbore.

15. The method as claimed in claim 10, wherein flow-back is executed to facilitate a decline of fracture pressure.

16. The method as claimed in claim 10, wherein a rate step-down test (RST) is executed to quantify the relationship between the injection rate and friction loss.

17. The method as claimed in claim 10, wherein the injection rate of the injection fluid is regulated manually or regulated by an automatic control system.

18. The method as claimed in claim 10, wherein maintaining a constant fracture pressure is achieved by regulating the injection rate of the injection fluid such that a bottom-hole pressure or a surface pressure is maintained at a constant level.

19. The method as claimed in claim 10, wherein the surface area of the created hydraulic fracture is estimated multiple times at different fracture pressures by repeating the steps of monitoring pressure in the wellbore, regulating the injection rate, and utilizing the numerical fluid leak-off model to estimate the surface area of the created hydraulic fracture.

20. The method as claimed in claim 10 further comprising calculating hydraulic fracture volume of the created hydraulic fracture based on volume balance, wherein the hydraulic fracture volume equals the fluid injection volume received by the created hydraulic fracture minus the total fluid leak-off volume from the created hydraulic fracture.

21. A system for estimating surface area of a created hydraulic fracture that originated from a wellbore, the system comprising:

a data storing arrangement configured to store a numerical fluid leak-off model, pressure and injection rate data, and wellbore configuration data;

an automatic control system comprising:

a pressure gauge configured to monitor pressure in the wellbore during and after creation and extension of the created hydraulic fracture; and a fluid injection device configured to inject fluid to the created hydraulic fracture;

a data processing arrangement communicatively coupled to the data storing arrangement and the automatic control system, and configured to:

identify, via the pressure gauge, a fracture pressure, wherein the identified fracture pressure is larger than a formation pore pressure and smaller than a fracture propagation pressure;

regulate, via the fluid injection device, injection rate of an injection fluid to the created hydraulic fracture to maintain a constant fracture pressure, such that the created hydraulic fracture maintains its current dimensions and the injection rate of the injection fluid into the created hydraulic fracture equals total fluid leak-off rate from the created hydraulic fracture, wherein the constant fracture pressure equals the identified fracture pressure; and utilize the numerical fluid leak-off model to estimate the surface area of the created closed hydraulic fracture, wherein the numerical fluid leak-off model performs numerical simulation to obtain the relationship between the total fluid leak-off rate and the surface area of the created hydraulic fracture, and wherein the numerical fluid leak-off model comprises a coupling of a wellbore model, a hydraulic fracture propagation model and a reservoir model to solve a system of equations for hydraulic fracture propagation and fluid flow within the hydraulic fracture and fluid flow inside the surrounding formation using at least one of: a finite element method, a finite volume method, a finite difference method and a boundary element method.

22. The system as claimed in claim 21, wherein the pressure gauge is installed on at least one of: a surface pipeline connecting to the wellbore, a junction of the surface pipeline, a wellhead of the wellbore and within the wellbore.

23. The system as claimed in claim 21, wherein the automatic control system comprises a controller to regulate the injection rate of the injection fluid to the created hydraulic fracture to maintain a constant fracture pressure.

24. A non-transitory computer-program product having computer-readable instructions stored therein that, when executed by a processor, cause the processor to perform method steps comprising:

receiving and storing pressure data during and after creation and extension of a created hydraulic fracture;

identifying a fracture pressure, wherein the identified fracture pressure is larger than a formation pore pressure and smaller than a fracture propagation pressure;

regulating injection rate of an injection fluid to the created hydraulic fracture to maintain a constant fracture pressure, such that the created hydraulic fracture maintains its current dimensions and the injection rate of the injection fluid into the created hydraulic fracture equals the total fluid leak-off rate from the created hydraulic fracture, wherein the constant fracture pressure equals the identified fracture pressure; and utilizing a numerical fluid leak-off model to estimate surface area of the created hydraulic fracture, wherein the numerical fluid leak-off model performs numerical simulation to obtain the relationship between the total fluid leak-off rate and the surface area of the created hydraulic fracture, and wherein the numerical fluid leak-off model comprises a coupling of a wellbore model, a hydraulic fracture propagation model, and a reservoir model to solve a system of equations for hydraulic fracture propagation and fluid flow within the hydraulic fracture and fluid flow inside the surrounding formation using at least one of: a finite element method, a finite volume method, a finite difference method, and a boundary element method.

* * * * *